US011253017B2

(12) United States Patent
Friedrich

(10) Patent No.: US 11,253,017 B2
(45) **Date of Patent: *Feb. 22, 2022**

(54) MULTILAYERED PERSPIRATION CONTROLLING GARMENTS

(71) Applicant: ENES APPAREL CORP, Atlanta, GA (US)

(72) Inventor: Robert Friedrich, Atlanta, GA (US)

(73) Assignee: ENES APPAREL CORP, Atlanta, GA (US)

( * ) Notice: Subject to any disclaimer, the term of this patent is extended or adjusted under 35 U.S.C. 154(b) by 1114 days.

This patent is subject to a terminal disclaimer.

(21) Appl. No.: 15/386,102

(22) Filed: Dec. 21, 2016

(65) Prior Publication Data

US 2017/0099895 A1 Apr. 13, 2017

Related U.S. Application Data

(63) Continuation of application No. 14/038,049, filed on Sep. 26, 2013, now Pat. No. 9,560,890.
(Continued)

(51) Int. Cl.
*A41D 27/13* (2006.01)
*A41B 1/08* (2006.01)
(Continued)

(52) U.S. Cl.
CPC ..... *A41D 27/13* (2013.01); *A41B 1/08* (2013.01); *A41D 31/125* (2019.02); *A41D 31/305* (2019.02); *Y10T 428/249921* (2015.04)

(58) Field of Classification Search
CPC ..... A41D 27/13; A41B 1/08; A41B 1/00
See application file for complete search history.

(56) References Cited

U.S. PATENT DOCUMENTS 2,344,781 A * 3/1944 Mullen ..... A41D 27/13 2/242
3,727,237 A * 4/1973 Glatt ..... A41D 27/13 2/56

(Continued)

FOREIGN PATENT DOCUMENTS

EP 0 619 953 A1 10/1994
EP 2410882 A1 2/2012

*Primary Examiner* — Clinton T Ostrup
*Assistant Examiner* — Andrew Wayne Sutton
(74) *Attorney, Agent, or Firm* — Shumaker, Loop & Kendrick, LLP

(57) ABSTRACT

Described herein are shields adapted for permanent attachment or removable attachment in the armpit area of a shirt. The shields are multi-layered fabrics that absorb perspiration, and in certain aspects, are used to control, reduce, or prevent perspiration from bleeding through and being shown on the outer surface of a garment. For example, these garments can include, but are not limited to, a multilayered fabric having at least a first fabric layer configured to wick moisture away from a person's body, at least a second fabric layer configured to absorb the moisture, and at least a third fabric layer that does not absorb moisture. As further described herein, various antimicrobial agents can be included in at least one fabric layer. These antimicrobial agents can be used to reduce or prevent the growth of microbes in and/or on the fabric, and these antimicrobial agents can be used to reduce or prevent odors derived from odor producing microbes.

28 Claims, 13 Drawing Sheets

Related U.S. Application Data

(60) Provisional application No. 61/791,075, filed on Mar. 15, 2013, provisional application No. 61/707,096, filed on Sep. 28, 2012.

(51) Int. Cl.
*A41D 31/12* (2019.01)
*A41D 31/30* (2019.01)

(56) References Cited

U.S. PATENT DOCUMENTS 4,205,679 A 6/1980 Repke et al.
4,573,987 A 3/1986 Lamb
4,641,381 A 2/1987 Heran et al.
4,813,950 A 3/1989 Branch
5,291,617 A 3/1994 Moretz et al.
5,546,607 A 8/1996 Roberts
5,562,648 A 10/1996 Peterson
5,669,902 A 9/1997 Sivilich
5,683,373 A 11/1997 Darby
6,848,121 B1 2/2005 Halid
7,166,095 B1 1/2007 Coates
7,842,625 B1 11/2010 Stockton et al.
8,117,675 B2 2/2012 Strange et al.
D701,018 S 3/2014 Wexler
8,935,813 B2 1/2015 O'Leary
9,011,403 B2 4/2015 De Bruin et al.
2005/0090795 A1 4/2005 Coleman
2006/0085886 A1* 4/2006 Williams ..... A41D 27/13 2/53
2008/0052802 A1* 3/2008 Bryan ..... A41B 9/06 2/54
2008/0096001 A1 4/2008 Emden ..... A41D 31/02 428/222
2008/0114327 A1 5/2008 Barge
2008/0222781 A1 9/2008 Rhew
2008/0276352 A1 11/2008 Strange et al.
2009/0082749 A1 3/2009 Scott et al.
2009/0276934 A1 11/2009 Lindsay ..... A41B 13/10 2/49.4
2012/0064313 A1 3/2012 Rock ..... A41B 17/00 428/212
2012/0071849 A1 3/2012 Kumar
2012/0180198 A1 7/2012 Ruggieri
2012/0288648 A1 11/2012 Shull ..... A41B 13/10 428/35.2
2013/0041339 A1 2/2013 Taylor
2013/0046265 A1 2/2013 Felix
2014/0018756 A1 1/2014 De Bruin et al.
2014/0039432 A1 2/2014 Dunbar et al.
2014/0090141 A1* 4/2014 Friedrich ..... A41D 27/13 2/54
2014/0109285 A1 4/2014 Amarasiriwardena .. A41B 1/08 2/69
2014/0157476 A1 6/2014 Del Rosario ..... A41D 27/12 2/46

* cited by examiner

Indicates

T-Shirt Seams under arm pit

MULTILAYERED PERSPIRATION CONTROLLING GARMENTS

CROSS REFERENCE TO RELATED APPLICATIONS

This U.S. Non-Provisional patent application is a continuation claiming priority from U.S. Non-Provisional patent application Ser. No. 14/038,049 filed on Sep. 26, 2013, which claims priority from U.S. Patent Application No. 61/707,096 filed on Sep. 28, 2012 and from U.S. Patent Application No. 61/791,075 filed on Mar. 15, 2013, which are incorporated by reference herein in their entirety.

TECHNICAL FIELD

This disclosure relates to multilayered perspiration controlling fabrics and various articles, which can include garments, having the fabrics described herein. For example, in one aspect the garment can include a tee shirt having a multilayered perspiration controlling fabric described herein.

BACKGROUND

In mammals, perspiration is a physiological response that aids in thermoregulation. Sweat glands typically excrete perspiration as a fluid mixture of various chemical components. For example, human perspiration is a fluid mixture consisting primarily of water, urea, 2-methyphenol (o-cresol), 4-methylphenol (p-cresol), and various dissolved chlorides.

Human perspiration rates vary widely depending on numerous factors including outdoor temperature and/or climate, amount of physical activity, physical activity intensity, gender, the presence or absence of various congenital or acquired medical conditions (e.g., hyperhidrosis, focal hyperhidrosis, etc.), emotional stress including anxiety, etc. For example, under certain environmental and working conditions (e.g., outdoor, manual labor during summer in a temperate climate), studies have shown that humans can perspire up to 12 liters per day. Even under climate controlled conditions (e.g., indoors at temperatures between 72 to 76° F.), the average sedentary human body has been shown to perspire between 400 mL and 4 liters. In addition, human studies have shown that men typically begin perspiring much more quickly than women, and in certain instances, perspire more than twice as much as women while being subjected to similar conditions.

Although many people believe that human perspiration leads to body odor, this belief is ill founded. While human perspiration includes dissolved solutes, human perspiration is typically odorless and/or virtually undetectable by human olfaction. However, certain odor causing bacterial flora such as *S. epidermidis* and members of the *Corynebacterium* genus reside on the human body. These odor causing bacterial flora often feed on human perspiration and create odorant substances when metabolizing human perspiration. Thus, a person with a high odor causing bacterial flora or a person who excessively perspires while having an average amount of odor causing bacterial flora can potentially be more prone to body odor and/or to producing body odor causing substances either while or after perspiring.

In certain occupational and social settings, negative social stigmas and connotations can arise from perspiration and/or body odor indirectly caused from perspiration. For example, certain individuals may find the slightest amount of perspiration that "bleeds through" the outer surface of a fabric, such as the outer surface of a shirt, both undesirable and/or unprofessional.

SUMMARY

To avoid negative social stigmas and connotations, it is desirable to control, reduce, or prevent perspiration from bleeding through, for example, clothing fabric in certain occupational and social settings. Described herein are multilayered fabrics that can be used to absorb perspiration. In certain aspects, these fabrics can be used to control, reduce, or prevent perspiration from bleeding through and being shown on the outer surface of a garment. For example, these garments can include, but are not limited to, a multi-layered fabric having at least a first fabric layer configured to wick moisture away from a person's body, at least a second fabric layer configured to absorb the moisture, and at least a third fabric layer that does not absorb moisture. As further described herein, various anti-microbial agents can be included in at least one fabric layer. These antimicrobial agents can be used to reduce or prevent the growth of microbes in and/or on the fabric, and these anti-microbial agents can be used to reduce or prevent odors derived from odor producing microbes. The advantages of this disclosure will be set forth in part in the description which follows or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE DRAWINGS

FIG. 3(*b*) shows a photograph of the first surface of the first fabric layer. FIG. 3(*c*) shows a second surface of the first fabric layer.

FIG. 4 illustrates, for example, additional absorbing layers being disposed in the multilayered fabric.

FIG. 5(*a*) illustrates the multilayered fabric being permanently attached to a garment. FIG. 5(*b*) shows a magnified view of the box shown in FIG. 5(*a*).

FIG. 8(*c*) shows a shield made from joining two pieces of multi-layered fabric together.

DETAILED DESCRIPTION OF THE EMBODIMENTS

Figure 1:
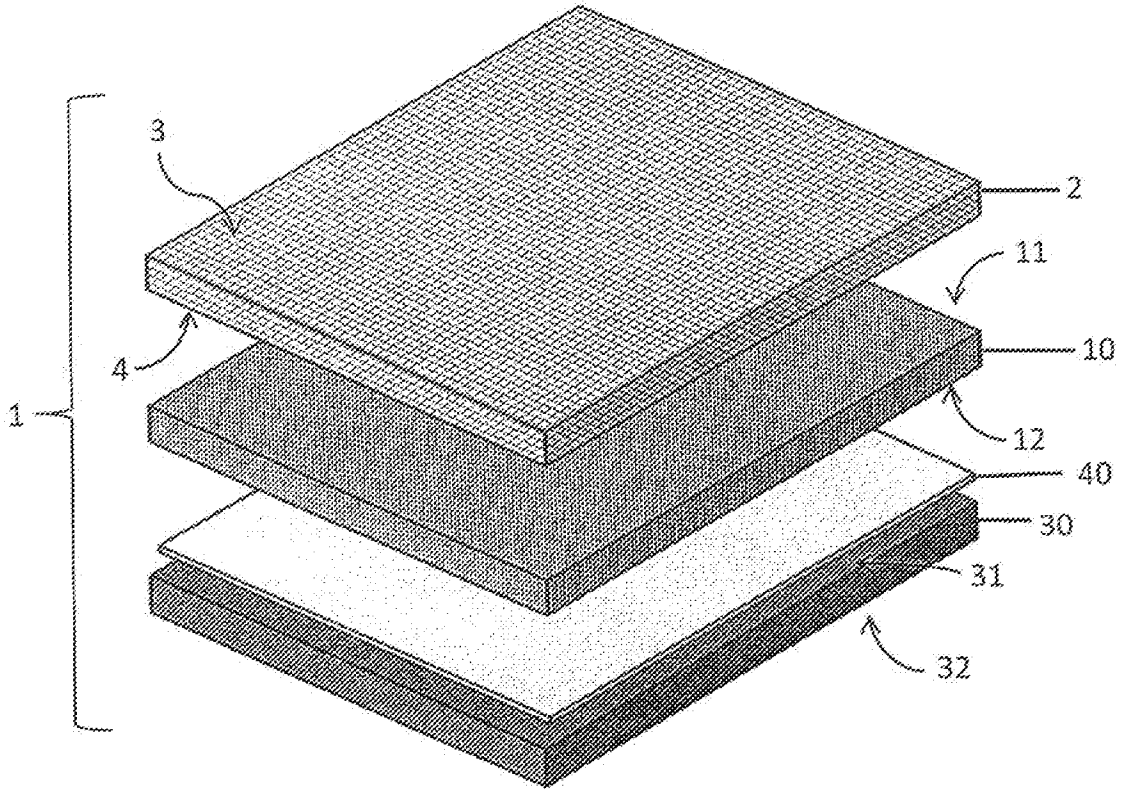
FIG. 1 shows a representative schematic depiction of a multi-layered fabric having a first fabric layer, a second fabric layer, and a third fabric layer.

The disclosed compositions and articles may be understood more readily by reference to the following detailed description of particular embodiments, the Examples included herein, and to the Figures and their descriptions. The aspects described below are not limited to specific compositions and/or methods as described which may, of course, vary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within the ranges as if each numerical value and sub-range is explicitly recited. As an illustration, a numerical range of "about 1 to 5" should be interpreted to include not only the explicitly recited values of about 1 to about 5, but also include individual values such as 2, 3, and 4 and sub-ranges such as from 1-3, from 2-4, and from 3-5, etc. as well as 1, 2, 3, 4, and 5, individually. The same principle applies to ranges reciting only one numerical value as a minimum or maximum. Furthermore, such an interpretation should apply regardless of the breadth of the range or the characteristics being described.

In this specification and in the claims that follow, reference will be made to a number of terms that shall be defined to have the following meanings:

"Anti-microbial agent" includes a substance capable of preventing or reducing the growth of a microorganism by 20% or more, by 30% or more, by 40% or more, by 50% or more, by 60% or more, by 70% or more, 80% or more, by 85% or more, by 90% or more, by 95% or more, by 97% or more, by 99% or more, when compared to a substrate or surface that does not include the anti-microbial agent. In certain aspects, microorganisms include a bacteria (or bacterium), fungi, algae, protozoa, or a combination thereof.

Described herein are multilayered fabrics that can be used to absorb moisture, such as perspiration. These fabrics have a variety of purposes including being used in athletic garments or garments used for business and social purposes. In certain aspects, these fabrics can control, reduce, or prevent perspiration from bleeding through and being shown on the outer surface of the garment. For example, these garments can include, but are not limited to, a multilayered fabric having at least a first fabric layer configured to wick moisture away from a person's body, at least a second fabric layer configured to absorb the moisture, and at least a third fabric layer that does not absorb moisture. As further described herein, various antimicrobial agents can be included in at least one fabric layer. These antimicrobial agents can be used to reduce or prevent the growth of microbes in and/or on the fabric, and these antimicrobial agents can be used to reduce or prevent odors derived from odor producing microbes.

As briefly described above, the multilayered fabric can include at least three distinct fabric layers having different properties (e.g., different rates of absorbency and hygroscopicity) and structural characteristics. Each layer can include either a woven fabric or a non-woven fabric made from a natural substance, an artificial substance, or a combination thereof (e.g., a semi-synthetic substance). Natural substances can include any material derived from plants or animals. For example, natural substances derived from plants can include, but are not limited to, cellulosic materials such as cotton, hemp, jute, flax, ramie, sisal, and any combination thereof. In certain aspects, these natural substances can further include fibers, thread, and yarn. Artificial substances can include any polymeric material. In certain aspects, these polymeric materials can further include films, fibers, threads, and yarns.

Each layer can further include an antimicrobial agent that prevents or reduces the growth of microbes. It can be advantageous to incorporate these agents in the fabric layers to potentially prevent or reduce odor produce by odor causing microbes. These microbes can include, but are not limited to, a bacteria (or bacterium), fungi, algae, protozoa, or a combination thereof. In certain aspects, the antimicrobial agents prevent or reduce growth of microbes often found on the human body. For example, the antimicrobial agent can prevent or reduce growth of certain odor causing bacterial flora such as *S. epidermidis* and members of the *Corynebacterium* genus on/in the fabric layers and may potentially reduce the amount of bacteria on a human body if the fabric is contacted with a human's skin. In certain aspects, the antimicrobial agent can include but is not limited to copper, copper salts, silver, silver salts, nickel, nickel salts, or any combination thereof.

These fabric layers can include at least a first fabric layer configured to wick moisture (e.g., perspiration), at least a second fabric layer configured to absorb moisture, and at least a third fabric layer that does not absorb moisture. For example, FIG. 1 demonstrates a multilayered fabric (1) having a first fabric layer (2), the first fabric layer having at least a first surface (3) and a second surface (4), a second fabric layer (10), the second fabric layer having a first surface (11) and a second surface (12), and at least a third fabric layer (30), the third fabric layer having a first surface (31) and a second surface (32). FIG. 1 also shows a laminate (40) that can be included on or with the third fabric layer. In certain aspects, the multilayered fabric functions to wick moisture away from a surface. The moisture is then absorbed by at least the second fabric layer. In certain aspects, the moisture absorbed by the at least second fabric layer is retained within the at least second fabric layer until the moisture dries and/or evaporates. It is also preferred that the moisture cannot flow back into the first fabric layer, or it is preferred that the amount of moisture backflow is minimized. To further enhance retention of the moisture within the at least second fabric layer, the multilayer fabric includes at least a third fabric layer. As described further below, in certain aspects, the third fabric layer is moisture proof (i.e., waterproof) and does not absorb or minimally absorbs the moisture retained in the at least second fabric layer.

In certain aspects, the at least a second fabric layer is disposed between the at least first fabric layer and the at least third fabric layer. A surface of the second fabric layer can be disposed immediately adjacent to one surface of the first fabric layer to form an interface between the first and second fabric layers. On a side opposite of the first and second fabric interface, a second surface of the second fabric layer can be disposed immediately adjacent to one surface of the third fabric layer to form an interface between the second fabric layer and the third fabric layer. When disposed in this manner, the at least first, second, and third fabric layers can have a parallel orientation relative to the other fabric layers about an axis. Furthermore, when the fabric layers are disposed as described immediately above, the first layer and third layer can completely surround the at least second fabric layer. In other aspects, the first layer and third layer only surround portions of the second fabric layer. In further aspects, additional fabric layers or films can be disposed in between the first and second fabrics, in between the second and third fabrics, or any combination thereof. Similar to the second fabric layer described above, these additional fabric layers can be completely surrounded by the first and/or third fabric layers, or the first and third fabric layers surround portions of these additional layers.

Figure 2:
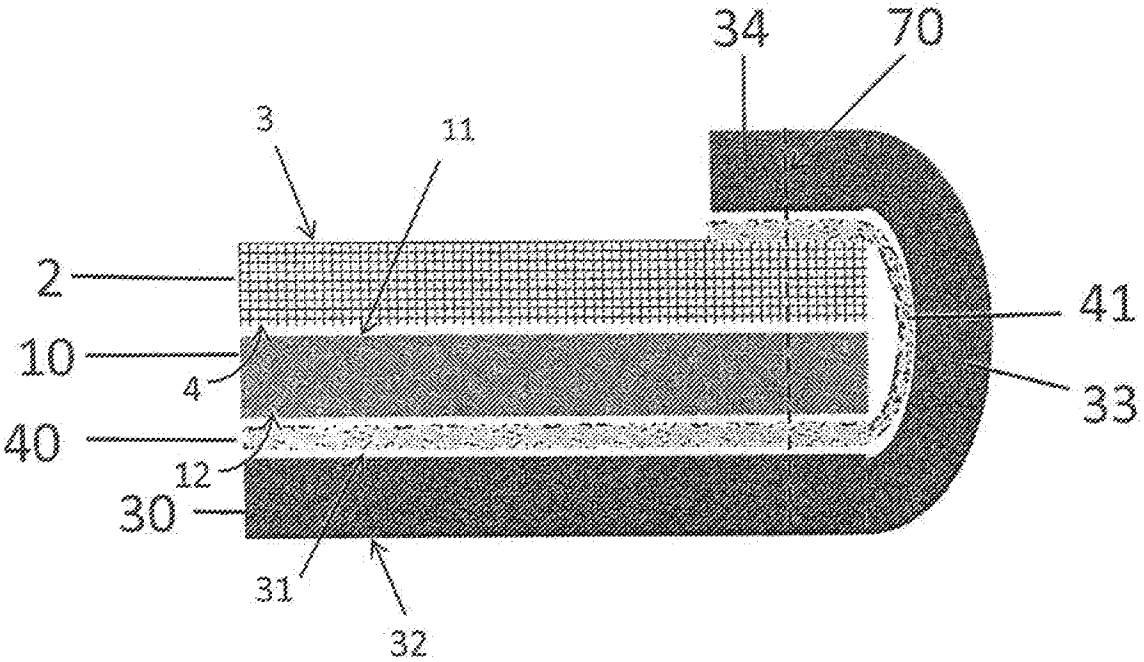
FIG. 2 shows a representative schematic of the ends of a first fabric layer, a second fabric layer, and a third fabric layer converging.

The fabric layers described herein can have end portions. For example, the at least first fabric layer can have at least one end portion, the at least second fabric layer can have at least one end portion, and the at least third fabric layer can have at least one end portion. In certain aspects, the multilayered fabric described herein can further have at least one end portion. The at least one portion of the multilayered fabric can be formed by converging at least one end portion of one fabric layer with at least one end portion of another fabric layer. For example, an end portion of the at least first fabric layer and an end portion of the at least third fabric layer can converge to form one end portion of the multilayered fabric. In certain aspects, it can be preferable to converge at least one end portion of the first fabric with at least one end portion of the second fabric and at least one end portion of the third fabric to form an end portion of the multilayered fabric. When the fabric layers described above are converged to form an end portion of the multilayered fabric, it is preferable to fixably attach the end portions of the fabric layers together to form the multilayered fabric. FIG. 2 shows an exemplary depiction of the end portion of the multilayered fabric. As shown in FIG. 2, in certain aspects the an end portion of the multilayered fabric can include the first fabric layer (3), the second fabric layer (10), and the third fabric layer converging to form an end portion of the multilayered fabric. In certain aspects, a portion of the barrier layer (33) can wrap around end portions of the first fabric layer (3) and the second fabric layer (10) to form an end portion of the multilayered fabric. In certain aspects, a laminate (40) can be included on or with the third fabric layer (30), and this laminate (40) can also wrap around end portions of the first fabric layer (3) and the second fabric layer (10). In certain aspects, an end portion (34) of the looped (33) third fabric layer can be fixed or permanently attached (70) to the first fabric layer (3), the second fabric layer (10), the laminate (40) if present), to another portion of the third fabric layer (30), or any combination thereof. In certain aspects, it may be beneficial to include this wrapped portion (33) to further prevent or reduce moisture transfer from the multi-layered fabric into or onto a garment. In this aspect, the wrapped portion can enhance trapping efficiency of the multilayered fabric when, for example, the multilayered fabric is shaped into a shield-like article and attached to a garment as described further below.

The end portions of the fabric layers can be fixably attached by various forms and methods of attachment. For example, the end portions of the fabric layer can be fixably attached by stitching the end portions together to form an end portion of the multilayered fabric. Alternatively, the end portions of the fabric can be fixably attached via an adhesive. For example, at least one end portion of the fabric layer being fixably attached to another end portion of a different fabric layer can include an adhesive. This adhesive can function to fixably attach one end portion of a fabric layer to an end portion of a separate fabric layer to form an end portion of the multilayered fabric. Examples of adhesives include, but are not limited to, contact adhesives, pressure adhesives, and hot melt adhesives. In certain aspects, end portions of the fabric layer can be fixably attached by using both stitching and adhesives.

First Fabric Layer

The multilayered fabric described herein includes at least a first fabric layer. The first fabric layer can be a woven or non-woven fabric, and this fabric layer can have multiple surfaces that are either identical or that differ from one another.

Figure 3A:
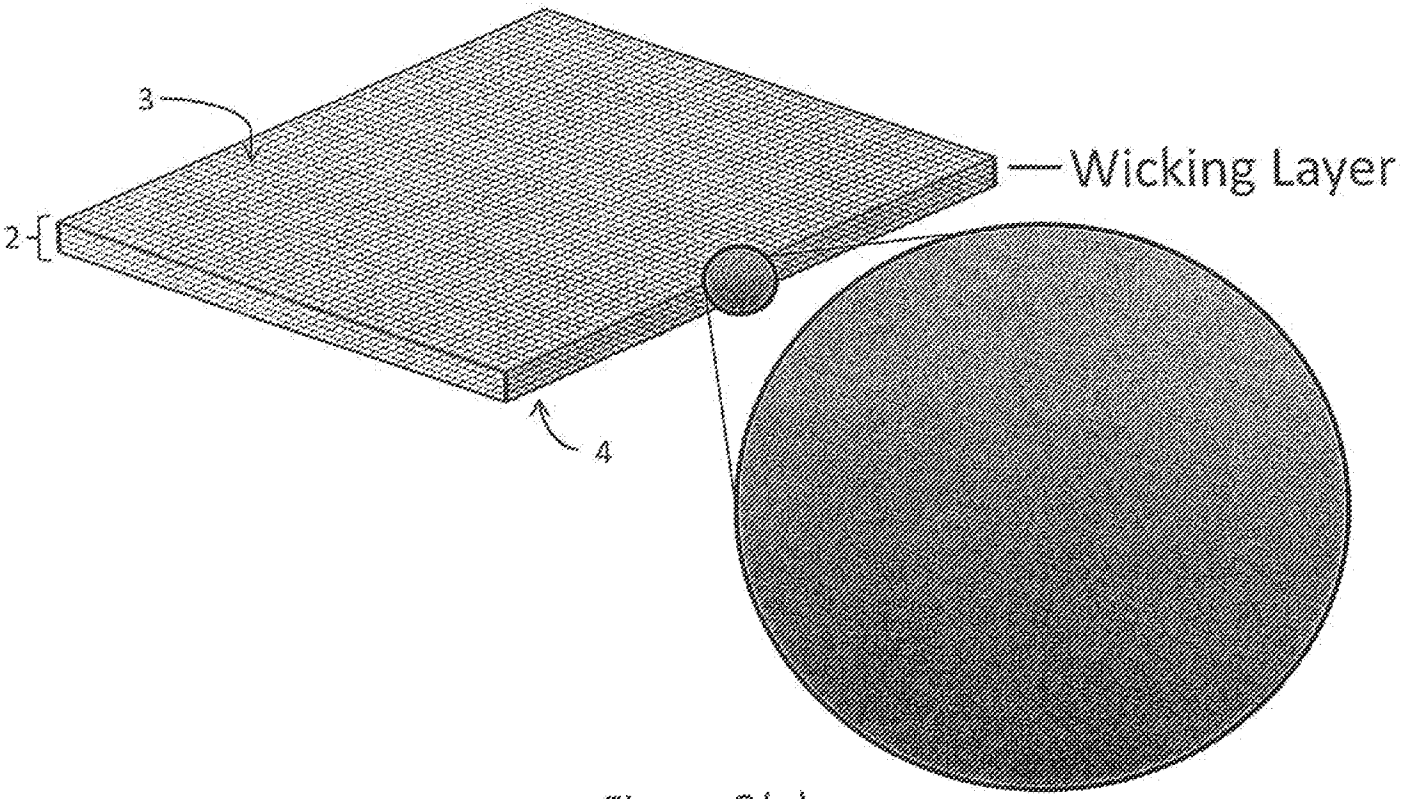
FIG. 3(*a*) shows a schematic depiction of a woven first fabric layer, where one surface of the first fabric (e.g., the first surface of the first fabric layer) is more tightly woven than a second surface of the first fabric layer (e.g., the second surface of the first fabric layer).
Figure 3C:
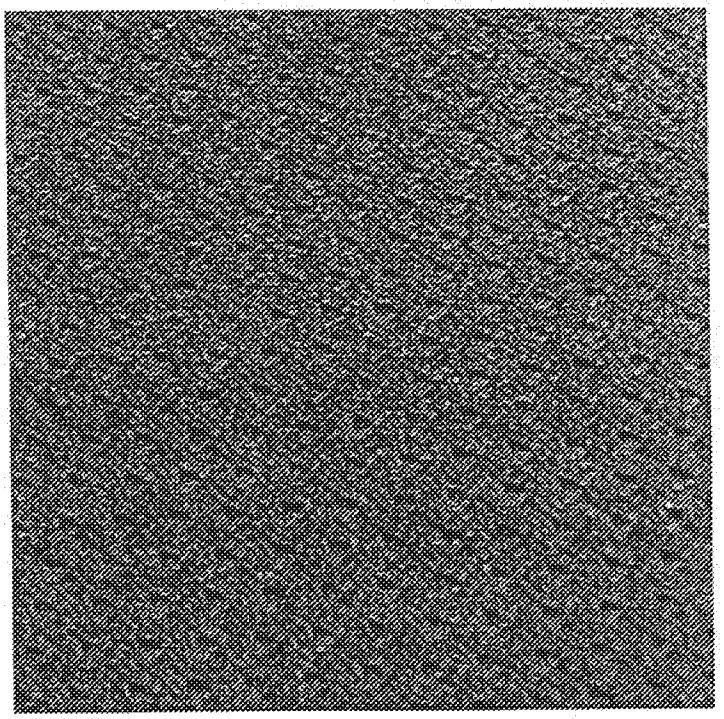
Figure 3B:
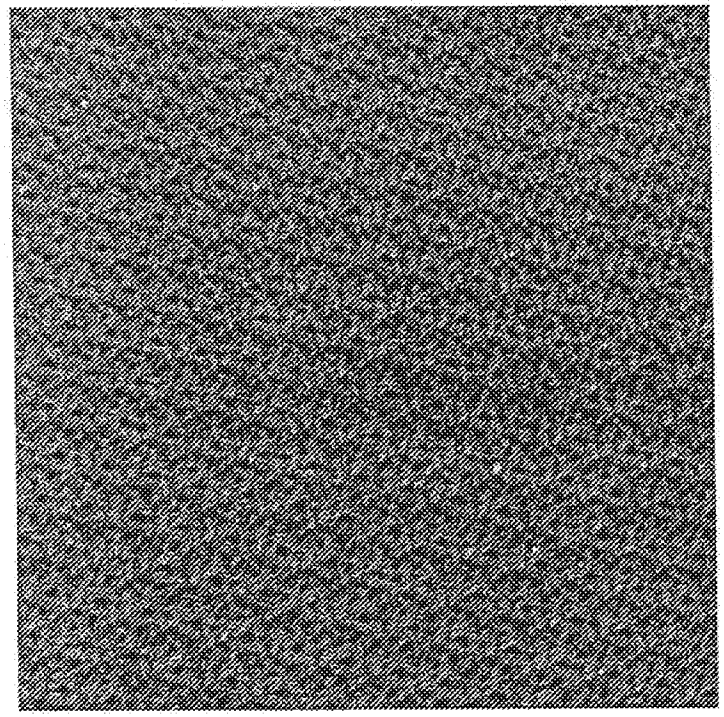

For example, in certain aspects, the first fabric layer is configured to wick away moisture (e.g., perspiration) from a human body and direct the moisture towards the second fabric layer of the multilayered fabric as described in further detail below. This wicking effect preferably occurs by capillary action in which the moisture flows between narrow spaces within the first fabric layer and towards the second fabric layer without the assistance of external forces (e.g., gravity). To facilitate and further enhance the wicking effect of the first fabric layer, the first fabric layer has a first surface and a second surface, which vary from one another. For example, in one aspect, the first fabric layer is a woven material. In this aspect, the woven first fabric layer includes a first surface and a second surface. To generate the wicking effect described above, the first surface (e.g., feature (3) of FIG. 1) of the woven first fabric should be more tightly woven than the second surface (e.g., feature (4) in FIG. 1) of the woven first fabric layer, and the second surface of the woven first fabric layer should be more loosely woven than the first surface of the first fabric layer. In addition to having these differing surfaces, the first surface of first fabric layer (i.e., the surface having the tighter weave) should be oriented more closely to the moist surface. For example, to maximize the wicking effect of the first fabric layer when wicking away perspiration from the human body, the first surface of first fabric layer (i.e., the surface having the tighter weave) should be oriented more closely to the human body. These wicking effects and principles can also be applied to non-woven fabric materials by similarly altering one surface of the non-woven first fabric layer relative to a second surface of the non-woven first fabric layer. FIG. 3(*a*) shows the first fabric layer (2) having a first surface (3) and a second surface (4). As shown in FIG. 3(*a*), the first surface (3) has a more tightly woven surface relative to the second surface (4) of the first fabric layer. In this regard, the first fabric layer shown in FIG. 2 creates a wicking effect via capillary action. Furthermore, FIG. 3(*a*) shows a magnified view of the first surface (3) and the second surface (4) of the first fabric layer. FIG. 3(*b*) shows a photograph of the first surface of the first fabric layer. FIG. 3(*c*) shows a second surface of the first fabric layer. As shown in FIGS. 3(*b*) and 3(*c*), the first and second surface of the first fabric layer differ from each other. FIG. 3(*b*) illustrates the tighter weave described above while FIG. 3(*c*) illustrates the looser weave described above.

In certain aspects the first fabric layer can be made from a natural substance, an artificial substance, or a combination thereof (e.g., a semi-synthetic substance). In certain aspects the first fabric layer is made from a polymeric substance. In this aspect, the polymeric substance can, include but is not limited to, a semi-aromatic co-polymer such as polyester. In certain aspects, the first fabric layer includes at least one polyester selected from the group of polyethylene terephthalate, polybutylene terephthalate, polytrimethylene terephthalate, and any combination thereof. In certain aspects, the polymeric substance can comprise at least 60 wt %, at least 65 wt %, at least 70 wt %, at least 75 wt %, at least 80 wt %, at least 85 wt %, at least 90 wt %, at least 95 wt %, at least 98 wt %, or 100 wt % of the overall weight of the first fabric layer.

When producing the first fabric layer it may be desirable to further include an antimicrobial agent. The antimicrobial agent can be either incorporated into, for example, a polymeric substance used to make the first fabric layer or the first fabric layer can be further coated with the antimicrobial agent. As described above, the antimicrobial agent can include but is not limited to copper, copper salts, silver, silver salts, nickel, nickel salts, or any combination thereof. In certain aspects, the first fabric layer includes 0 to 30 wt %, 0 to 25 wt %, 0 to 20 wt %, 0 to 15 wt %, 0 to 10 wt %, 0 to 5 wt %, 0 to 3 wt %, 1 to 10 wt %, 2 to 8 wt %, 3 to 6 wt % of the antimicrobial agent in the first fabric layer or coated on the first fabric layer.

In certain aspects, the first fabric layer is made entirely from an artificial substance or a semi-synthetic substance being made from both artificial and natural substances. In certain aspects it may be desirable to make the first fabric layer from entirely a polymeric substance (e.g., a polyester). In other aspects the first fabric layer can include a blend and/or mixture of a polymeric substance and the antimicrobial agent. For example, in certain aspects, the first fabric layer can be made from a material having 80 to 100 wt % of a polymeric substance and 0 to 30 wt % of the antimicrobial agent. (Weight percentage being calculated from the overall weight of the material comprising the first fabric layer.) In certain aspects, the first fabric layer includes at least one polyester selected from the group of polyethylene terephthalate, polybutylene terephthalate, polytrimethylene terephthalate, and any combination thereof, wherein the at least one polyester comprises 80 to 100 wt % of the first fabric layer's overall weight, and in this aspect, the fabric layer can include at least one antimicrobial agent selected from the group consisting of copper, copper salts, silver, silver salts, nickel, nickel salts, or any combination thereof, wherein the antimicrobial agent comprises 0 to 30 wt % of the first fabric layer's overall weight. In other aspects, the first fabric layer can include one polyester selected from the group of polyethylene terephthalate, polybutylene terephthalate, polytrimethylene terephthalate, and any combination thereof, and the first fabric layer can be blended with or coated with the antimicrobial agent. When the first fabric layer is blended with or coated with the antimicrobial agent, the polymeric substance can comprise 80 to 100 wt % and the antimicrobial agent can comprise 0 to 30 wt % of the antimicrobial agent of the first fabric layer's overall weight.

In certain aspects, it may be desirable that the first fabric layer includes the highest amount of antimicrobial agent because the first fabric layer comes in closest contact with the surface containing moisture. More specifically, it may be desirable that the first surface of the first fabric layer (e.g., the surface with the tighter weave when the first fabric layer is a woven material) have the highest amount of antimicrobial agent because the first surface of the first fabric layer will be in closest proximity to a surface containing moisture. In this aspect, the first surface of the first fabric layer can have at least 1.1, 1.2, 1.3, 1.4, 1.5, 2, 3, 4, 5, 6, 7, 8, 9, or 10 times more antimicrobial agent than any other surface in the multilayered fabric and/or than any other fabric layer in the multilayered fabric. However, in other aspects, the first fabric layer does not include an antimicrobial agent.

In certain aspects, it is important for the first fabric layer to maintain the qualities described above after 1, 5, 10, 15, 20, 25, 30, 35, 40, 45, 50, or more wash machine cleanings, which includes washing the first fabric layer in the presence of cleaning agents such as washing detergent(s) and/or bleach. In certain aspects, the wash machine cleaning ranges from 5 to 60 minutes in length, 10 to 45 minutes in length, 15 to 35 minutes in length, or 20 to 30 minutes in length.

Second Fabric Layer

The multilayered fabric described herein includes at least a second fabric layer (see, for example, FIG. 1 feature (10)) that functions as a moisture absorbent layer that can be either a woven or non-woven fabric. This fabric layer can have multiple surfaces (see, for example, FIG. 1 features (11) and (12)) that can be either identical to or different from one another. Moreover, in certain aspects, it is preferable that the at least second fabric layer is the most hygroscopic fabric layer within the multilayered fabric.

To achieve the characteristics described immediately above, it is preferable that the second fabric layer be made of a semi-synthetic substance, a natural substance (e.g., bamboo and derivatives thereof, cotton, etc.), or any combination thereof. For example, the semi-synthetic substance can include, but is not limited to, hygroscopic materials such as rayon and derivatives thereof. For example, the hygroscopic material can include, but is not limited to, modal, bamboo (i.e., a natural substance), or a combination thereof. In certain aspects, these hygroscopic materials do not contain cotton, and in certain aspects, these hygroscopic materials are at least 40% or more, 50% or more, 60% or more, 70% or more, 80% or more, 85% or more, 90% or more, 95% or more hygroscopic per unit volume than cotton. In this aspect, the second fabric layer includes at least 70 wt %, at least 75 wt %, 80 wt %, 85 wt %, 90 wt %, 95 wt %, or at least 99 wt % modal, bamboo, or a combination thereof as the overall weight of the second fabric layer. In certain aspects, the second fabric layer does not include cotton, polyester (or derivatives thereof), an antimicrobial agent, or any combination thereof.

Similar to the first fabric layer described above, it may be desirable to include the antimicrobial agent into the second fabric layer or to coat the second fabric layer with the antimicrobial agent. In certain aspects, the second fabric layer includes 0 to 30 wt %, 0 to 25 wt %, 0 to 20 wt %, 0 to 15 wt %, 0 to 10 wt %, 0 to 5 wt %, 0 to 3 wt %, 1 to 10 wt %, 2 to 8 wt %, 3 to 6 wt % of the antimicrobial agent blended in its fabric layer or coated on the second fabric layer. (Weight percentage being calculated from the overall weight of the material comprising the second fabric layer.) In this aspect, the fabric layer can include at least one antimicrobial agent selected from the group consisting of copper, copper salts, silver, silver salts, nickel, nickel salts, or any combination thereof. In certain aspects and to prevent and/or to reduce growth of microbes in the second fabric layer, it is desirable that the second fabric layer includes the most antimicrobial agent. For example, the second fabric layer can include at least 1.1, 1.2, 1.3, 1.4, 1.5, 2, 3, 4, 5, 6, 7, 8, 9, or 10 times more anti-microbial agent than any other fabric layer of the multilayered fabric.

In certain aspects, the second fabric layer includes at least modal, at least one polymeric substance, and at least one antimicrobial agent. For example, the second fabric layer can include at least 70 wt % modal and from 0 to 30 wt % of the anti-microbial agent. In yet another aspect, the second fabric layer can include at least 90 wt % modal and from 3 to 6 wt % of the antimicrobial agent.

In certain aspects, it is important for the second fabric layer to maintain the qualities described above after 1, 5, 10, 15, 20, 25, 30, 35, 40, 45, 50, or more wash machine cleanings, which includes washing the second fabric layer in the presence of cleaning agents such as washing detergent(s) and/or bleach. In certain aspects, the wash machine cleaning ranges from 5 to 60 minutes in length, 10 to 45 minutes in length, 15 to 35 minutes in length, or 20 to 30 minutes in length.

Third Fabric Layer

The third fabric layer described herein is a woven or non-woven fabric and is preferably the least moisture absorbing fabric layer included in the multilayered fabric. In certain aspects, the third fabric layer does not absorb any moisture or minimally absorbs moisture. For example, the third fabric layer can be completely waterproof. This fabric can further be a waterproof breathable fabric. In the multilayered fabric, the third fabric layer can function to trap any moisture present in the multilayered fabric inside the second fabric layer because the third fabric layer does not absorb moisture or minimally absorbs moisture present in the second fabric layer. In certain aspects, it is important for the third fabric layer to maintain these non-absorbent qualities after 1, 5, 10, 15, 20, 25, 30, 35, 40, 45, 50, or more wash machine cleanings, which can include the addition of cleaning agents such as washing detergent(s) and/or bleach. In certain aspects, the wash machine cleaning ranges from 5 to 60 minutes in length, 10 to 45 minutes in length, 15 to 35 minutes in length, or 20 to 30 minutes in length.

This third fabric layer can be made of an artificial substance such as a polymeric substance (e.g., artificial substances), semi-synthetic substance, a natural substance, or any combination thereof. In certain aspects, it is preferable that the third fabric layer be made entirely of a polymeric substance or the third fabric layer can include at least 80 wt %, 85 wt %, 90 wt %, 95 wt %, or at least 99 wt % of the polymeric substance. For example, the third fabric layer can include only a single polymeric substance, or the third fabric layer can include a plurality of polymeric substances. These polymeric substances can further include, but are not limited to, polyester, polyurethane, polyvinyl chloride, silicone elastomer, fluoropolymers (e.g., a perfluoroalkane derivative such as perfluorobutanesulfonic acid), synthetic waxes (e.g., polyethylene based waxes, polymerized olefin waxes, Fischer-Tropsch waxes, etc.), or any combination thereof.

In certain aspects and to achieve minimal moisture absorbency, it is preferable that the third fabric layer is blend of polymeric substances. For example, blend of polymeric substances can include at least any two, at least any three, or at least any four of the polymeric substances selected from the group of polyester, polyurethane, polyvinyl chloride, silicone elastomer, fluoropolymers (e.g., a perfluoroalkane derivative such as perfluorobutanesulfonic acid), synthetic waxes (e.g., polyethylene based waxes, polymerized olefin waxes, Fischer-Tropsch waxes, etc.), or any combination thereof. In one aspect, the third fabric layer includes at least a blend of 30 to 80 wt %, 30 to 70 wt %, 40 to 60 wt %, 40 to 70 wt %, 50 to 65 wt %, 65 to 80 wt %, 75 to 80 wt % of polyurethane and 30 to 70 wt %, 35 to 70 wt %, 35 to 60 wt %, 40 to 55 wt %, 45 to 50 wt % of polyester.

Similar to the first and second fabric layers described above, it may be desirable to include the antimicrobial agent in the second fabric layer or to coat the second fabric layer with the antimicrobial agent. In certain aspects, the second fabric layer includes 0 to 30 wt %, 0 to 25 wt %, 0 to 20 wt %, 0 to 15 wt %, 0 to 10 wt %, 0 to 5 wt %, 0 to 3 wt %, 1 to 10 wt %, 2 to 8 wt %, 3 to 6 wt % of the antimicrobial agent in its fabric layer or coated on the third fabric layer. (Weight percentage being calculated from the overall weight of the material comprising the second fabric layer.) In this aspect, the fabric layer can include at least one antimicrobial agent selected from the group consisting of copper, copper salts, silver, silver salts, nickel, nickel salts, or any combination thereof. In certain aspects and to prevent and/or to reduce growth of microbes in the second fabric layer, it is desirable that the third fabric layer include the least antimicrobial agent. For example, when the antimicrobial agent is present, the third fabric layer can include 1.1, 1.2, 1.3, 1.4, 1.5, 2, 3, 4, 5, 6, 7, 8, 9, or 10 times less antimicrobial agent than any other fabric layer of the multilayered fabric. However, in certain aspects, the third layer does not include an antimicrobial agent.

In certain aspects, the third fabric layer may include at least two polymeric substances and at least one antimicrobial agent. For example, the third fabric layer can include 30 to 80 wt % polyurethane, from 35 to 60 wt % polyester, and from 0 up to 10 wt % of the antimicrobial agent.

In certain aspects, the third fabric layer has at least two surfaces. A first surface of the third fabric layer (e.g., FIG. 1, feature (31)) is configured to be closer or adjacent to a surface of the second fabric layer in the multilayer fabric than the second surface of the third fabric layer (e.g., FIG. 1, feature (32)). For example, the second surface of the third fabric layer can be disposed opposite of the first surface of the third fabric layer, and the second surface can an outermost surface of the multilayered fabric whereas the first surface can be disposed inside of the multilayered fabric. In certain aspects, the first and second surfaces of the third fabric layer can be identical or different depending on the desired overall properties and characteristics of the third fabric layer. For example, in certain aspects, it is desirable enhance overall non-absorbency of the entire third fabric layer. When enhancing overall non-absorbency of the entire third fabric layer, at least the first and second surface of the third fabric layer can be further treated or coated with a polymeric substance having waterproofing properties. For example, the first and second surfaces can be treated or coated with polyurethane, polyvinyl chloride, a silicone elastomer, fluoropolymers (e.g., a perfluoroalkane derivative such as perfluorobutanesulfonic acid), or any combination thereof. In certain aspects, the first and second surfaces can be treated or coated with polymeric films containing polyurethane, polyvinyl chloride, a silicone elastomer, fluoropolymers (e.g., a perfluoroalkane derivative such as perfluorobutanesulfonic acid), or any combination thereof. For example, the polymeric film can include a laminate film having at least polyurethane that is fixably attached to at least one surface of the third fabric layer. In certain aspects, the polymeric substance having waterproofing properties that can be used to treat or coat at least a surface of the third fabric layer can comprise at least 0, 1, 5, 8, 10, 15, 20, or 25 wt % of the overall weight of the third fabric layer.

In certain aspects, it is desirable to enhance non-absorbency of only one surface of the third fabric layer. For example, it may be desirable to enhance non-absorbency of the first surface of the third fabric layer (e.g., FIG. 1, feature (40)), which is the surface configured to be closer or adjacent to a surface of the second fabric layer in the multilayer fabric. In this aspect, it is preferred that the first surface of the third fabric layer be the most non-absorbent surface in the multilayered fabric. For example, the first surface of the third fabric layer can be at least 2, 3, 4, 5, 6, 7, 8, 9, or 10 times less absorbent than any other surface in the multilayered fabric. To achieve these characteristics, the first surface of the third fabric layer can be further treated or coated with a polymeric substance having waterproofing properties. For example, the first surface can be treated or coated with polyurethane, polyvinyl chloride, a silicone elastomer, fluoropolymers (e.g., a perfluoroalkane derivative such as perfluorobutanesulfonic acid), or any combination thereof. In certain aspects, the first surface can be treated or coated with polymeric films containing polyurethane, polyvinyl chloride, a silicone elastomer, fluoropolymers (e.g., a perfluoroalkane derivative such as perfluorobutanesulfonic acid), or any combination thereof.

Figure 4:
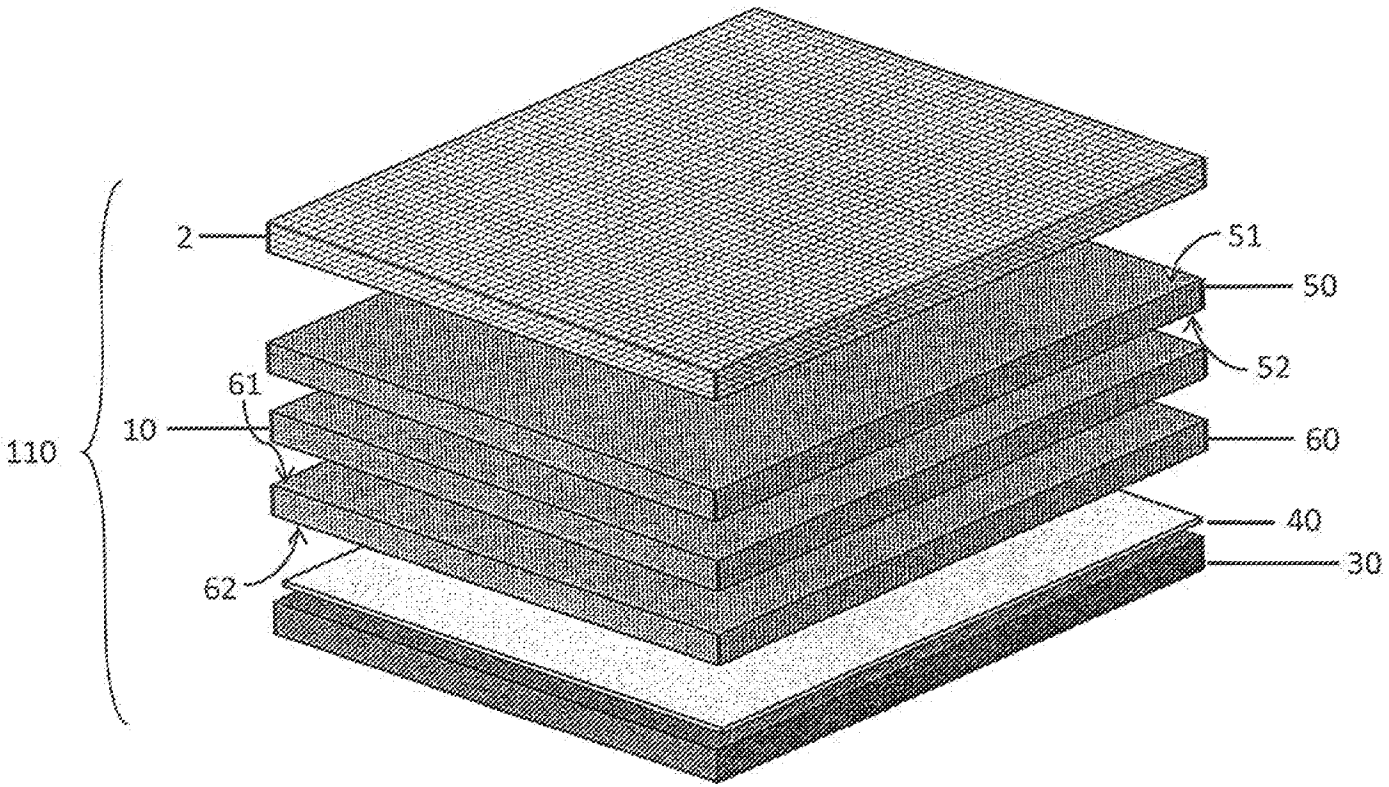
FIG. 4 shows an alternative embodiment where the multilayered fabric includes additional layers between the first fabric layer, the second fabric layer, and the third fabric layer of the multilayered fabric.

In alternative embodiments, the multilayered fabrics can optionally include additional layers other than the at least first, second and third layers described above. For example, FIG. 4 shows an alternative embodiment where the multi-layered fabric includes additional absorbing layers (e.g., feature (50) and feature (60)) between the first fabric layer (2) and the third fabric layer (30) being made from the materials described in the second fabric layer above and having similar properties to the second fabric layer described above. In this aspect, the absorbing layers (50), (10), and (60) shown in FIG. 4 can either vary in absorbency characteristics/properties or be identical in absorbency characteristics/properties. In certain aspects, it can be desirable to have three different absorbent layers (e.g., (50), (10), and (60)). In this aspect, one absorbent layer (e.g., feature (10) of FIG. 4) is disposed between two other absorbent layers (features (50) and (60)) and has an absorbency that differs from the other absorbent layers. For example, in certain aspects, the absorbent layer (10) disposed between the two other absorbent layers can have the highest absorbent properties/characteristics to facilitate trapping of moisture within this layer. In other aspects, the layer (e.g., feature (60)) disposed closest to the third fabric layer (30) has the highest absorbent properties relative to the other absorbent layers (e.g., features (50) and (10)) and these absorbency characteristic/properties further facilitate and enhance trapping of moisture within this layer (e.g., feature (60)).

Articles

Figure 5B:
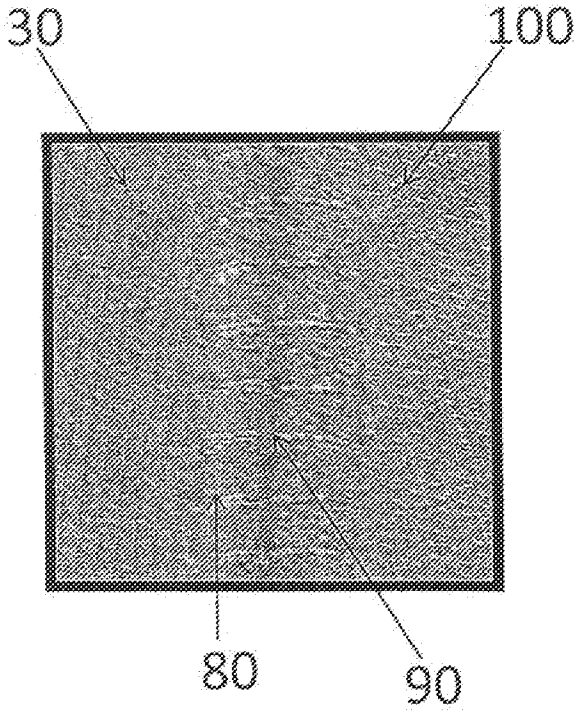
FIG. 5(*a*) shows the multilayered fabric as an article.
Figure 5A:
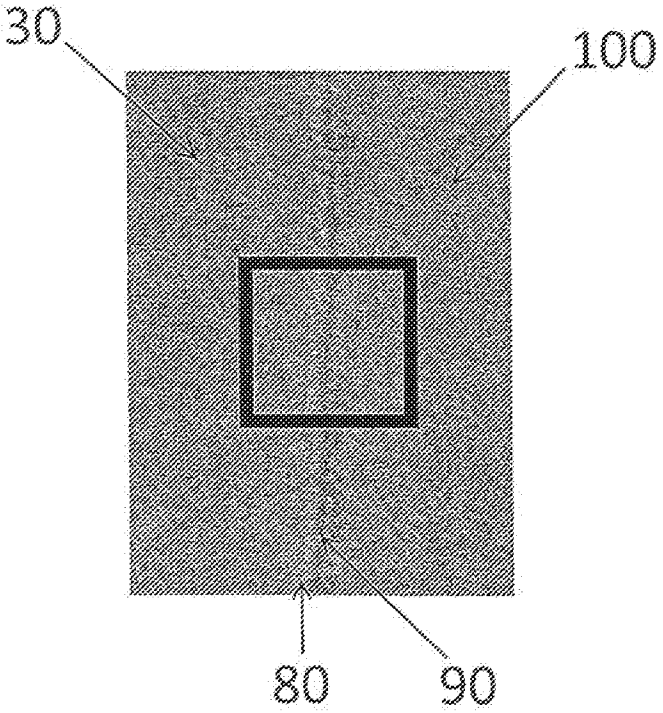

The multilayered fabrics described herein can be made into numerous articles including, but not limited to, garments or inserts configured to be either removably incorporated or permanently incorporated into garments. In certain aspects, these articles having the multi-layered fabrics can be inserted into pouches within a garment. In other aspects, these articles having the multi-layered fabrics can be incorporated into a garment by permanently fixing the multi-layered fabric article either to or within the garment by various methods including but not limited to stitching, cross-stitching, various forms of adhering with adhesives, or any combination thereof. FIG. 5(*a*) shows a surface of third fabric layer (30) of the multi-layered fabric and a surface of the garment (100). FIG. 5(*a*) further shows an end portion of the multi-layered fabric and an end portion of the garment being aligned adjacent relative to one another to form a seam (90). The end portion of the multi-layered fabric and the end portion of the garment shown in FIG. 5(*a*) are fixed to one another by stitching (80) the end portion of the multi-layered fabric to the end portion of the garment. In some aspects, the end portion of the multi-layered fabric shown in FIG. 2 can be fixed to an end portion of the garment by stitching the two end portions together. FIG. 5(*b*) shows a magnified view of the end portions shown in FIG. 5(*a*) being stitched together.

The garments described above can include, but are not limited to, athletic garments or garments used for business and social purposes. For example, these garments can include any type of shirt, and in certain aspects, these garments are tee shirts. As described above, these multilayered fabrics can be used to control, reduce, or prevent perspiration from bleeding through and being shown on the outer surface of the garment by using the wicking features, the absorbent features, and the non-absorbent features described above.

Figure 6:
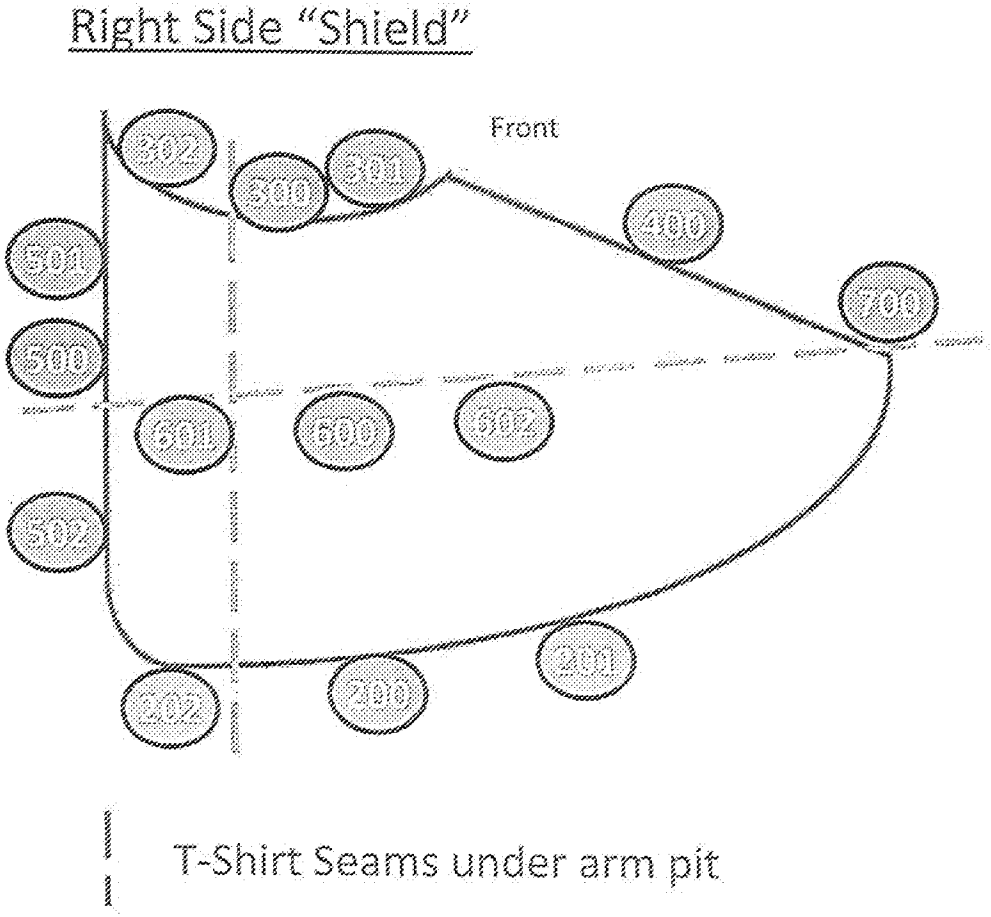
FIG. 6 shows a schematic depiction of the multilayered fabric in the form of a shield.

As described herein are exemplary embodiments of articles made of the multi-layered fabric configured to be removably or permanently incorporated into garments including shirts. In certain aspects, these articles can be in the form of a shield configured to be incorporated into, for example, a tee shirt. These shields can be made of a single piece of the multi-layered fabric or the shield can include multiple pieces of the multi-layered fabric joined together. For example, FIG. 6 shows an exemplary form of the shield. This shield is a single piece of the multi-layered fabric that is incorporated into the underarm area of a shirt and positioned in such a manner to cover most or substantially all of the garment wearer's sweat glands in the underarm area. For example, in FIG. 6, the intersection of the two dotted lines indicates the substantially anatomical center of a wearer's underarm and further demonstrates where tee-shirt seams intersect substantially about the anatomical center of a wearer's underarm. The alignment of the article shown in FIG. 6 with a wearer's underarm is further depicted as "shield" position. "Shield" position demonstrates the positioning of the shield on or within a tee shirt. In certain aspects, (200) is a first end portion of the article and is designed to be a portion of the article closest to the garment wearer's anatomical midline With respect to the wearer's body, (200) extends lengthwise in an axial direction from the wearer's pectoralis major/minor towards the latissimus dorsi. In certain aspects, (200) ranges from about 4 to 15 inches in length, 4.5 inches to 14.5 inches in length, 5 inches to 13 inches in length, 5.5 inches to 12.5 inches in length, 6.0 inches to 12 inches, 6.5 inches to 11.5 inches in length, 7.0 inches to 11 inches in length, 7.5 inches to 11 inches in length, 8.0 inches to 11 inches in length, 8.5 inches to 11 inches in length, 9.0 inches to 11.0 inches in length, 9.5 to 11 inches in length, 10 to 11 inches in length, 10.5 to 11 inches in length, or any combination thereof, wherein any values within the ranges disclosed above can be used to form additional ranges. In certain aspects, the first end portion (200) has a length that is greater than any of the second, third, and fourth end portions of the article (e.g., (300), (500), and (400)) described below.

The article shown in FIG. 6 has a second end portion (300) that is located in a direction opposite (200). In certain aspects, this second end portion (300) extends in an axial direction substantially parallel to (200). In other aspects, this end portion (300) extends in a diagonal direction relative to the axial direction of the first end portion (200). The second end portion (300) shown in FIG. 6 is designed to be a portion of the article located farthest away from the garment wearer's anatomical midline. With respect to the wearer's body, (300) extends lengthwise in an axial direction from the biceps brachii towards the triceps brachii. In certain aspects, (300) ranges from about ranges from about 3.5 to 9.5 inches in length, 4 to 9 inches in length, 4.5 inches to 8.5 inches in length, 5 inches to 8 inches in length, 5.5 inches to 7.5 inches in length, 6.0 inches to 7.0 inches, or any combination thereof, wherein any values within the ranges disclosed above can be used to form additional ranges. In certain aspects, the second end portion (300) has a length that is less than the length of the first end portion (e.g., (200)) of the article described herein. In certain aspects, the second end portion (300) has a length that is greater than the length of the fourth end portion (400).

In certain aspects, the distance between the opposing end portions of (200) and (300) of the article are separated by the multilayered fabric extending in a direction beginning near the wearer's anatomical midline and extending away from the wearer's anatomical midline. In certain aspects, the distance between the opposing end portions (200) and (300) ranges from 4 inches to 16 inches in length, 5 inches to 15 inches in length, 6 inches to 13 inches in length, 6.5 inches to 12 inches in length, 6.5 inches to 10 inches in length, 7 inches to 10 inches in length, 7 inches to 9.5 inches in length, 7 to 8.5 inches in length, 7 inches to 8 inches in length, 7 inches to 7.5 inches in length, or any combination thereof, wherein any values within the ranges disclosed above can be used to form additional ranges.

In certain aspects, the article shown in FIG. 6 has a third end portion (500) that connects an end portion of (200) to an end portion of (300). The third end portion (500) extends in a direction that is perpendicular to the first end portion (200) and the second end portion (300) and in a direction originating from about the garment wearer's anatomical midline (e.g., around the latissimus dorsi) and going away from the anatomical midline in a radial direction (e.g., in a direction towards the wearer's elbow). In certain aspects, the third end portion (500) ranges from 4 inches to 13 inches in length, 4.5 inches to 12 inches in length, 5.0 inches to 11 inches in length, 5.5 inches to 10 inches in length, 6.0 inches to 9 inches in length, 6.5 inches to 8 inches in length, 7.0 inches to 8.0 inches in length, 7.5 to 8 inches in length, or any combination thereof, wherein any values within the ranges disclosed above can be used to form additional ranges. In certain aspects, the third end portion has a length that is greater than at least one of either the first end portion (200) or the second end portion (300). In one aspect, the first end portion (200) has a length that is greater than both the second and third end portions (e.g., (300) and (500)).

In certain aspects, the article shown in FIG. 6 has a fourth end portion (400) formed in a direction opposite the third end portion (500). The fourth end portion can be substantially parallel in an axial direction relative to the third end portion (500) or the fourth end portion can extend in a diagonal axial direction that intersects with the third end portion (500). Similar to the third end portion (500), the fourth end portion (400) connects a second end of (200) to a second end of (300). The fourth end portion (400) extends in a direction that is perpendicular to the first end portion (200) and the second end portion (300) and in a direction originating from about the garment wearer's anatomical midline (e.g., the wearer's pectoralis major/minor muscles) and going away from the anatomical midline in a radial direction (e.g., in a direction toward the wearer's elbow). In certain aspects, the fourth end portion (400) ranges from 4 inches to 12 inches in length, 5 inches to 11 inches in length, 6 inches to 10 inches in length, 6.5 inches to 9 inches in length, 6.5 inches to 8.5 inches in length, 7.0 inches to 8 inches in length, 7.0 inches to 7.5 inches in length, or any combination thereof, wherein any values within the ranges disclosed above can be used to form additional ranges. In certain aspects, the fourth end portion has a length that is greater than or equal to at least the third end portion.

Figure 7:
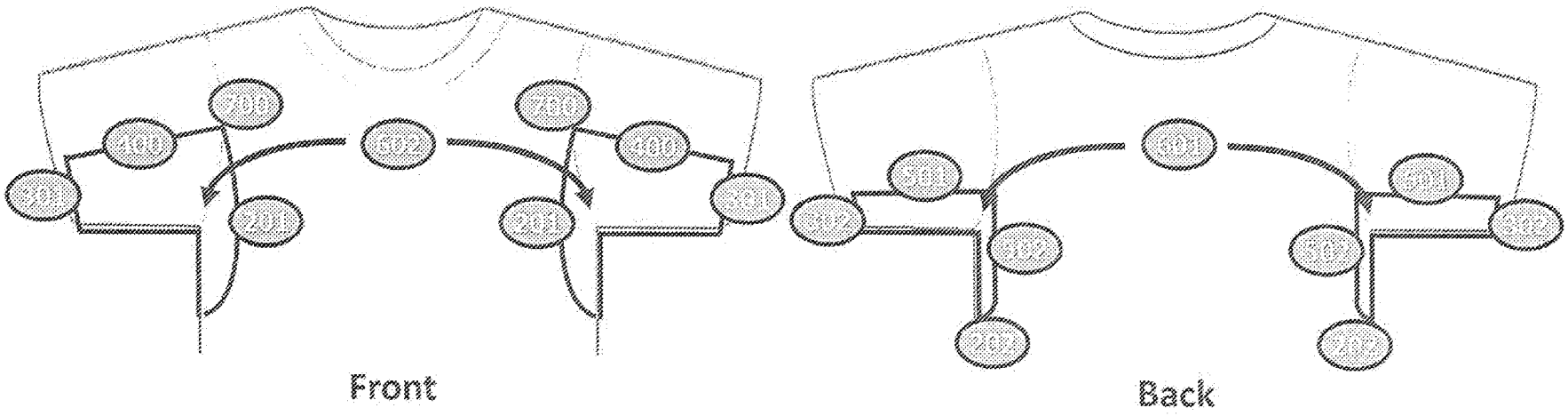
FIG. 7 shows a schematic depiction of the multilayered fabric in the form of a shield being attached to a tee shirt.

FIG. 6 also demonstrates the article position (e.g., the shield position) in the garment (e.g., the tee shirt). As shown in FIGS. 6 and 7, the majority of the article can be oriented on the front side of the garment. For example, the majority of the article can be oriented on the front side of a tee shirt. In this regard, at least portions of the first end portion of the article (200), the second end portion of the article (300), and the fourth end portion of the article (400) can be oriented in the front side of a tee shirt, and substantially all of the third end portion (500) can be oriented in the back side of the tee shirt. In certain aspects, at least ⅔, at least 7/10, at least 8.5/11, at least 10/12.5, or at least 9/11 of the overall length of the first end portion (200) can be oriented in the front side of article. For example, FIG. 6 shows the first end portion (200) divided into two sections based on where a tee-shirt seam intersects (the intersection being close to the anatomical center of the armpit). As shown in FIG. 6, (201) of the first end portion (200) is oriented in the front side and (202) of the first end portion (200) is oriented in the back side of a tee shirt, when the article is attached/fixed to a tee shirt. FIG. 7 described further below provides additional views of these features. To further demonstrate this aspect, the first end portion (200) can be, for example, 12.5 inches in length. In this aspect, approximately 10/12.5 of the first end portion of the article can be oriented in the front side of the garment and approximately 2.5/12.5 of the first end portion of the article can be oriented in the back side of the garment. To further demonstrate, approximately 10 inches (e.g., feature (201)) of the first end portion (200) can be oriented in the front side of the garment and approximately 2.5 inches (e.g., feature (202)) can be oriented in the back side of the garment.

Furthermore, as shown in FIG. 6, the article includes a length (600) that is measured from a portion of the third end portion (500) to the intersection (700) of the first end portion (200) and fourth end portion (400). In certain aspects this length (600) bifurcates the third end portion (e.g., (501) and (502)). In this aspect, the length of (600) can be about 8 to 15 inches in length, 9 inches to 14 inches in length, 9 inches to 13 inches in length, 10 inches to 12 inches in length, or 10 inches to 11 inches. In this aspect, the bifurcated third end portion (features (501) and (502)) can have equal lengths or one length can be, for example, ⅗ or ⅖ of the overall length of the third end portion (500) while the other length can be for, example ⅖ or ⅗ of the overall length of the third end portion (500). For example, the third end portion (500) can have, for example, an overall length of 7 inches, and both (501) and (502) can be 3.5 inches in length. In other aspects, the third end portion (500) can have, for example, an overall length of 7 inches, and in this aspect, (501 can have a length of 4 inches while (502) has a length of 3 inches.

In certain aspects, at least ⅗, at least ⅝, at least ⅔, or at least ¾ of the overall length of the second end portion (300) can be oriented in the front side of the article when the article is integrated into or attached/fixed to the tee shirt. For example, FIG. 6 shows the second end portion (300) divided into two sections (e.g., features (301) and (302)) based on where a tee-shirt seam intersects (the intersection being close to the anatomical center of the armpit). As shown in FIG. 6, (301) of the second end portion (300) is oriented in the front side and (302) of the second end portion (300) is oriented in the back side of a tee shirt, when the article is attached/fixed to or integrated into a tee shirt. FIG. 7 described further below provides additional views of these features. To further demonstrate this aspect, the second end portion (300) can be, for example, 8 inches in length. In this aspect, approximately ⅝ of the second end portion of the article can be oriented in the front side of the garment and approximately ⅜ of the second end portion of the article can be oriented in the back side of the garment. To further demonstrate, approximately 5 inches (e.g., feature (301)) of the second end portion (300) can be oriented in the front side of the garment and approximately 3 inches (e.g., feature (302)) can be oriented in the back side of the garment.

As described immediately above, FIG. 6 demonstrates how the article can be positioned or disposed (e.g., the lengths of the end portions) when attached or fixed to the garment. FIG. 7 further demonstrates this concept by showing how this positioning applies when the article is attached/fixed to or integrated into a tee shirt. FIG. 7 shows a front side or "front view" of a wearer's tee shirt and a back side or a "back view" of the wearer's tee shirt and the relative orientation of the first end portion (200), the second end portion (300), the third end portion (500), and the fourth end portion (400).

Figure 8A:
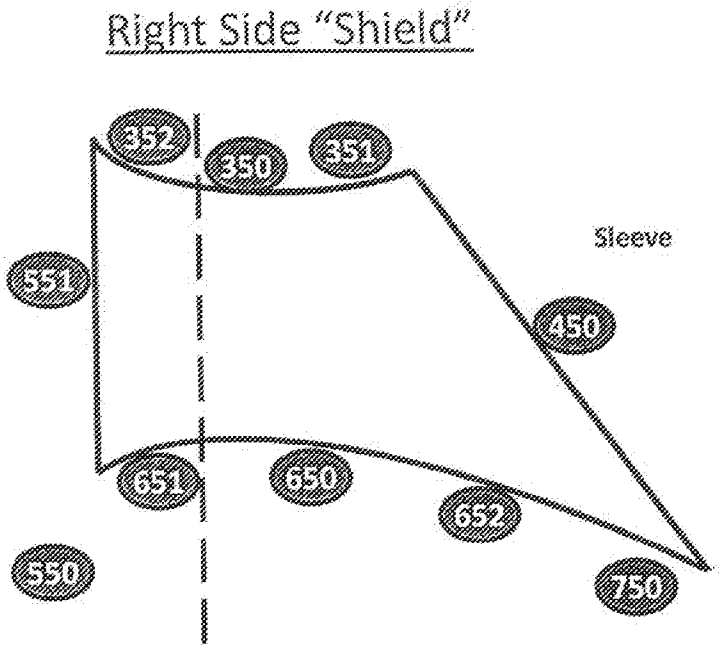
FIGS. 8(*a*) and 8(*b*) show two individual pieces of the multi-layered fabric, which can be joined together to form a shield.
Figure 8B:
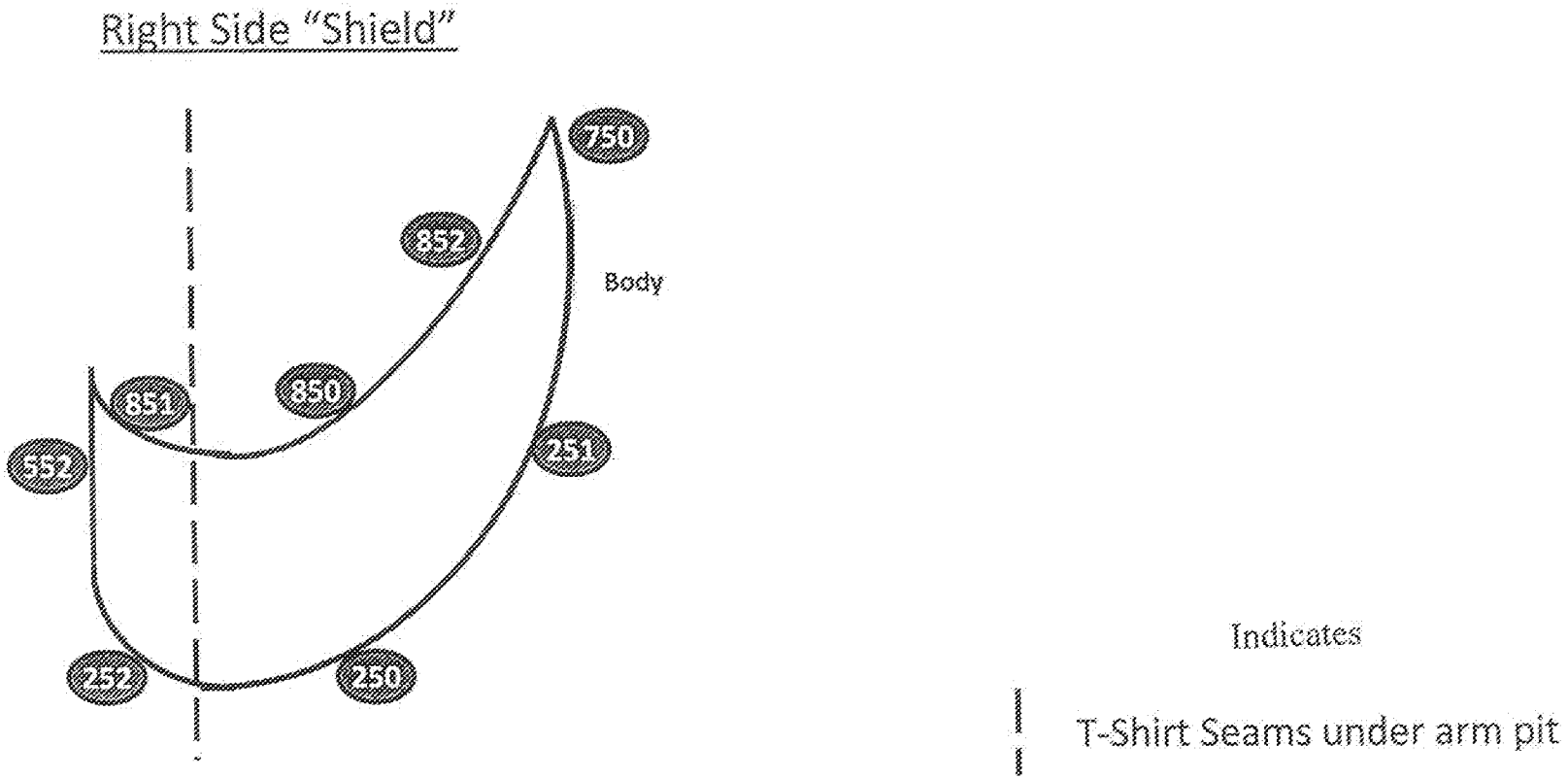
Figure 8C:
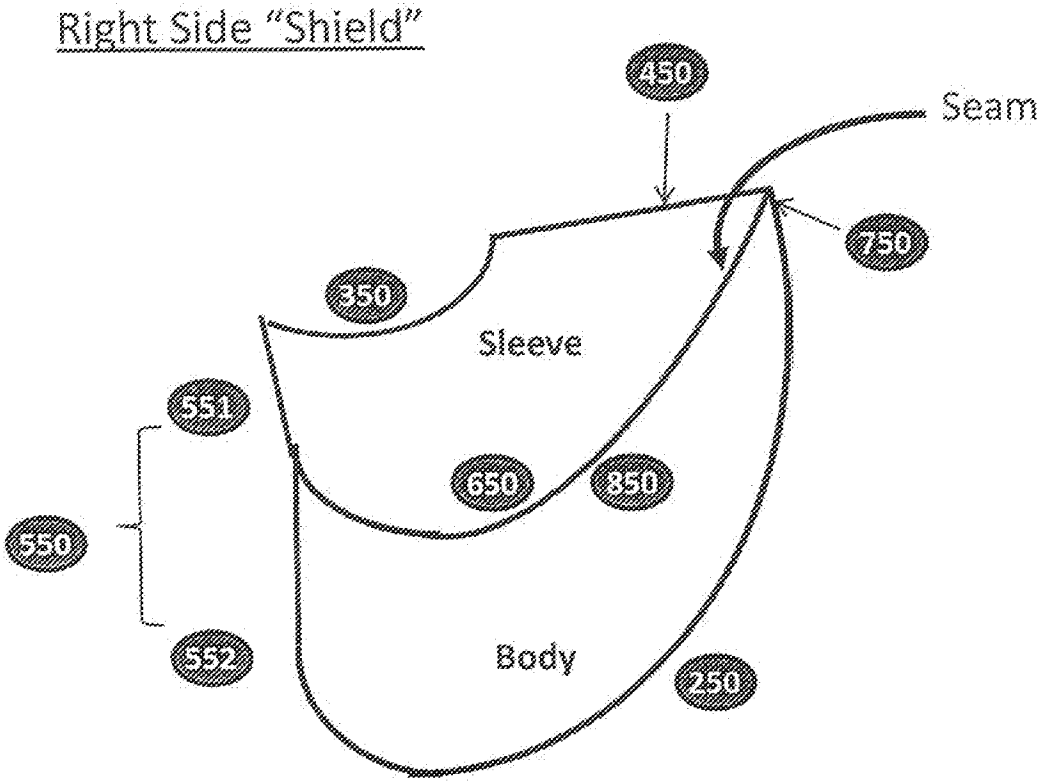
Figure 9:
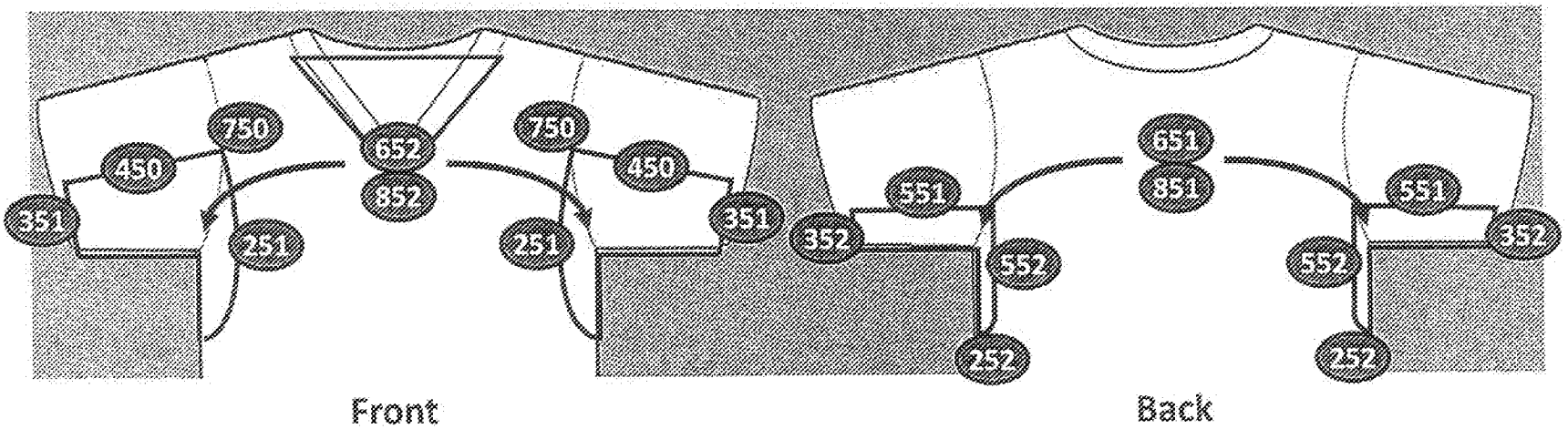
FIG. 9 shows a schematic depiction of the shield (being made from two individual pieces of the multi-layered fabric) being attached to a tee shirt.

FIGS. 8 and 9 show an additional embodiment of the shields described herein. For example, FIG. 8(*a*) and FIG. 8(*b*) each show individual pieces of the multilayered fabric that can be joined together to form a shield. In certain aspects, a shield made from multiple pieces of the multilayered fabric may be beneficial because this shield configuration can potentially allow for better mobility and more overall comfort when the shield is attached/fixed to a garment (e.g., a tee shirt). For example, in certain aspects, a shield made from multiple pieces of the multilayered fabric can better contour to a garment wearer's body and provides the garment wearer with a more natural, less bulky appearance.

FIG. 8(*a*) shows a first piece of the multilayered fabric configured to join with a second piece of multilayered fabric to form the shield shown, for example, in FIG. 8(*c*). FIG. 8(*b*) shows the second piece of multilayered fabric configured to join with the first piece of multilayered fabric to form the shield shown, for example, in FIG. 8(*c*). In certain aspects, the individual pieces of multilayered fabric shown in FIGS. 8(*a*) and 8(*b*) can be joined together to form the shield.

As shown in FIG. 8(*a*), in certain aspects, the first piece of the multilayered fabric includes a first end portion (350), a second end portion (450), a third end portion (650), and a fourth end portion (551). As shown in FIG. 8(*b*), in certain aspects the second piece of the multilayered fabric includes a first end portion (250), a second end portion (552), a third end portion (850), and a fourth end portion (750).

In certain aspects, a partial length of the third end portion (650) of the first piece of the multilayered fabric and a partial length of the third end portion (850) of the second piece of the multilayered fabric can be joined together to form the shield. In certain aspects, the entire length of the third end portion (650) of the first piece of the multi-layered fabric and an entire length of the third end portion (850) of the second piece of the multilayered can be joined together to form the shield. For example, FIG. 8(*c*) shows a shield made by joining a first piece of multilayered fabric (e.g., FIG. 8(*a*)) with a second piece of multilayered fabric (e.g., FIG. 8(*b*)).

As discussed above, two pieces of the multi-layered fabric can be joined together to form a shield configured to be incorporated into the underarm area of a shirt and positioned in such a manner to cover most or substantially all of the garment wearer's sweat glands in the underarm area. Thus, similar to the other embodiments described above, the shield is positioned in the tee shirt to maximize the garment wearer's comfort while also maximizing perspiration absorption. For example, FIG. 9 illustrates two pieces of the multilayered fabric that have been joined together and then attached/fixed to a tee shirt.

FIG. 9 further illustrates positioning the shield (as shown in FIG. 8(*c*)) being attached/fixed on or to a tee shirt. In certain aspects, (250) is a first end portion of a shield made from two pieces of the multi-layered fabric and is designed to be a portion of the article closest to the garment wearer's anatomical midline. With respect to the wearer's body, (250) extends lengthwise in an axial direction from the wearer's pectoralis major/minor towards the latissimus dorsi. In certain aspects, (250) ranges from about 6 to 16 inches in length, 6.5 inches to 15.5 inches in length, 7 inches to 15 inches in length, 7.5 inches to 14.5 inches in length, 8.0 inches to 14 inches, 8.5 inches to 13.5 inches in length, 9.0 inches to 13.5 inches in length, 11 inches to 13.5 inches in length, 11.5 inches to 13.5 inches in length, 11.5 inches to 13.0 inches in length, 12.0 inches to 13.5 inches in length, 12.0 to 13.0 inches in length, or any combination thereof, wherein any values within the ranges disclosed above can be used to form additional ranges. In certain aspects, the first end portion (250) has a length that is greater than any of the (350), (550), and (450) when the shield is formed from a first piece and a second piece of the multilayer fabric.

The shield shown in FIGS. 8(*c*) and 9, which is formed from a first piece and second piece of the multilayer fabric, has a second end portion (350) that is located in a direction opposite (250). In certain aspects, this second end portion (350) extends in an axial direction substantially parallel to (250). In other aspects, this end portion (350) extends in a diagonal direction relative to the axial direction of the first end portion (250). The second end portion (350) shown in FIG. 9 is designed to be a portion of the article located farthest away from the garment wearer's anatomical midline. With respect to the wearer's body, (350) extends lengthwise in an axial direction from the biceps brachii towards the triceps brachii. In certain aspects, (350) ranges from about ranges from about 3.0 to 9.0 inches in length, 3.5 to 8.5 inches in length, 4.0 inches to 8.0 inches in length, 4.5 inches to 7.5 inches in length, 4.5 inches to 7.0 inches in length, 4.5 inches to 6.5 inches, 4.5 inches to 6.0 inches, 4.5 inches to 5.5 inches, 4.5 inches to 5.0 inches, 5.0 inches to 5.5 inches, or any combination thereof, wherein any values within the ranges disclosed above can be used to form additional ranges. In certain aspects, the second end portion (350) of the shield formed from two pieces of the multilayered fabric has a length that is less than the length of the first end portion (e.g., (250)) of the shield described herein. In certain aspects, the second end portion (350) has a length that is greater than the length of the fourth end portion (450) of the shield formed from two pieces of the multilayered fabric.

In certain aspects, the distance between the opposing end portions of (250) and (350) of the article are separated by the multilayered fabric extending in a direction beginning near the wearer's anatomical midline and extending away from the wearer's anatomical midline. In certain aspects, the distance between the opposing end portions (250) and (350) ranges from 4 inches to 16 inches in length, 5 inches to 15 inches in length, 6 inches to 13 inches in length, 6.5 inches to 12 inches in length, 6.5 inches to 10 inches in length, 7 inches to 10 inches in length, 7 inches to 9.5 inches in length, 7 to 8.5 inches in length, 7 inches to 8 inches in length, 7 inches to 7.5 inches in length, or any combination thereof, wherein any values within the ranges disclosed above can be used to form additional ranges.

In certain aspects, the shield shown in FIG. 9 (being made from the two multilayered pieces shown in FIGS. 8(*a*) and 8(*b*)) has a third end portion (550) that connects an end portion of (250) to an end portion of (350). The third end portion (550) extends in a direction that is perpendicular to the first end portion (250) and the second end portion (350) and in a direction originating from about the garment wearer's anatomical midline (e.g., around the latissimus dorsi) and going away from the anatomical midline in a radial direction (e.g., in a direction towards the wearer's elbow). In certain aspects, the third end portion (550) ranges from 4 inches to 13 inches in length, 4.5 inches to 12 inches in length, 5.0 inches to 11 inches in length, 5.5 inches to 10 inches in length, 6.0 inches to 9 inches in length, 6.5 inches to 8 inches in length, 7.0 inches to 8.0 inches in length, 7.5 to 8 inches in length, or any combination thereof, wherein any values within the ranges disclosed above can be used to form additional ranges. In certain aspects, the third end portion has a length that is greater than at least one of either the first end portion (250) or the second end portion (350). In one aspect, the first end portion (250) has a length that is greater than both the second and third end portions (e.g., (350) and (550)).

In certain aspects, the article shown in FIG. 9 has a fourth end portion (450) formed in a direction opposite the third end portion (550). The fourth end portion can be substantially parallel in an axial direction relative to the third end portion (550) or the fourth end portion can extend in a diagonal axial direction that intersects with the third end portion (550). Similar to the third end portion (550), the fourth end portion (450) connects a second end of (250) to a second end of (350). The fourth end portion (450) extends in a direction that is perpendicular to the first end portion (250) and the second end portion (350) and in a direction originating from about the garment wearer's anatomical midline (e.g., the wearer's pectoralis major/minor muscles) and going away from the anatomical midline in a radial direction (e.g., in a direction toward the wearer's elbow). In certain aspects, the fourth end portion (450) ranges from 4 inches to 12 inches in length, 5 inches to 11 inches in length, 6 inches to 10 inches in length, 6.5 inches to 9 inches in length, 6.5 inches to 8.5 inches in length, 7.0 inches to 8 inches in length, 7.5 inches to 8.0 inches in length, 8.0 inches to 8.5 inches in length, or any combination thereof, wherein any values within the ranges disclosed above can be used to form additional ranges. In certain aspects, the fourth end portion has a length that is greater than or equal to at least the third end portion.

FIG. 9 also demonstrates the shield's position in a tee shirt. As shown in FIG. 9, the majority of the shield can be oriented on the front side of the garment. For example, the majority of the article can be oriented on the front side of a tee shirt. In this regard, at least portions of the first end portion of the shield (250) formed with two pieces of the multilayer fabric, the second end portion of the shield (350) formed with two pieces of the multilayer fabric, and the fourth end portion of the shield (450) formed with two pieces of the multilayer fabric can be oriented in the front side of a tee shirt, and substantially all of the third end portion of the shield (550) formed with two pieces of the multilayer fabric can be oriented in the back side of the tee shirt. In certain aspects, at least ⅔, at least 7/10, at least 8.5/11, at least 10/12.5, or at least 9/11 of the overall length of the first end portion (250) can be oriented in the front side of article. For example, FIG. 8(*c*) shows the first end portion (250) divided into two sections based on where a tee-shirt seam intersects (the intersection being close to the anatomical center of the armpit). As shown in FIG. 8(*c*), (251) of the first end portion (250) is oriented in the front side and (252) of the first end portion (250) is oriented in the back side of a tee shirt, when the article is attached/fixed to a tee shirt. FIG. 9 provides additional views of these features. To further demonstrate this aspect, the first end portion (250) can be, for example, 13 inches in length. In this aspect, approximately 11/13 of the first end portion of the article can be oriented in the front side of the garment and approximately 2/13 of the first end portion of the article can be oriented in the back side of the garment. To further demonstrate, approximately 11 inches (e.g., feature (251)) of the first end portion (250) can be oriented in the front side of the garment and approximately 2 inches (e.g., feature (252)) can be oriented in the back side of the garment.

Furthermore, as shown in FIGS. 8(*a*), 8(*b*), 8(*c*), and 9, the shield can include a seam formed by joining (650) and (850) together when making the shield from two pieces of the multilayered fabric. In certain aspects, the seam formed by joining (650) and (850) has a length that bifurcates the third end portion (e.g., (551) and (552)). In this aspect, the length of the seam formed when joining (650) and (850) can be about 8 to 15 inches in length, 9 inches to 14 inches in length, 9 inches to 13 inches in length, 10 inches to 12 inches in length, or 10 inches to 11 inches. In this aspect, the bifurcated third end portion (features (551) and (552)) can have equal lengths or one length can be, for example, ⅗ or ⅖ of the overall length of the third end portion (550) while the other length can be for, example ⅖ or ⅗ of the overall length of the third end portion (550). For example, the third end portion (550) can have, for example, an overall length of 8 inches, and both (551) and (552) can be 4 inches in length. In other aspects, the third end portion (550) can have, for example, an overall length of 8 inches, and in this aspect, (551) can have a length of 4.5 inches while (552) has a length of 3.5 inches.

As described immediately above, FIG. 9 demonstrates how the shield can be positioned or disposed (e.g., the lengths of the end portions) when attached or fixed to the garment. FIG. 9 further demonstrates this concept by showing how this positioning applies when the shield is attached/fixed to or integrated into a tee shirt. FIG. 9 shows a front side or "front view" of a wearer's tee shirt and a back side or a "back view" of the wearer's tee shirt and the relative orientation of the first end portion (250), the second end portion (350), the third end portion (550), and the fourth end portion (450).

Figure 10:
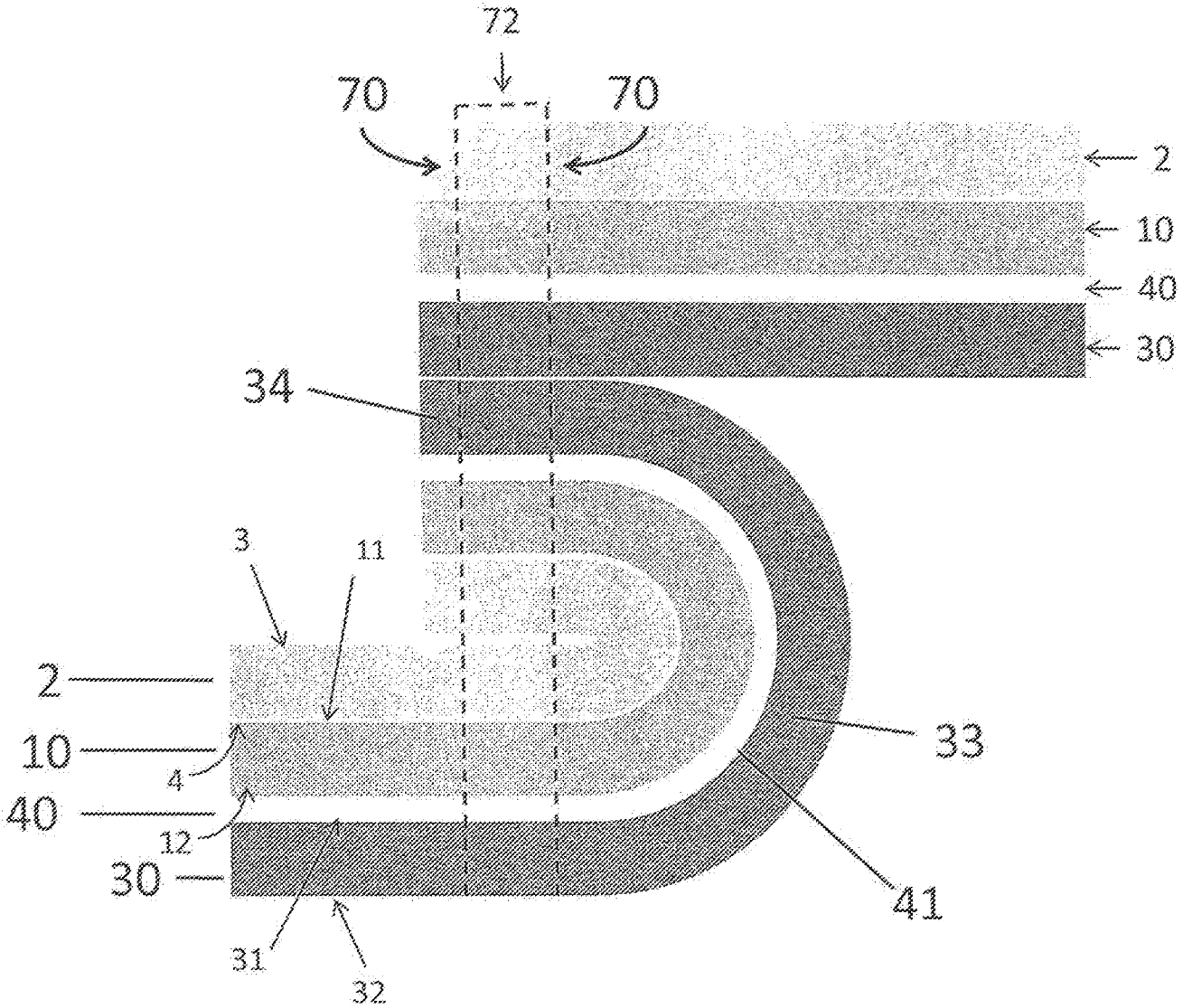
FIG. 10 shows a cross-sectional view of the seam formed when two individual pieces of the multilayered fabric are joined together to form a shield.

FIG. 10 shows a cross-sectional view of the seam formed (e.g., by (650) and (850)) when two individual pieces of the multilayered fabric are joined together to form a shield. For example, as shown in FIG. 10, an end portion of one individual piece of multilayered fabric (e.g., (650)) is overlapped with an end portion of a second individual piece of multilayered fabric (e.g., (850)) by placing one end portion over another end portion. In this aspect, the overlapping end portions are then joined together by, for example, stitching, various forms of adhesive bonding, or a combination thereof. In certain aspects, the overlapping end portions are stitched together. When using stitching to join the two end portions (e.g., (650) and (850), it may be preferable to use an overlock coverstitch. For example, the schematic illustrated in FIG. 10 demonstrates overlock coverstitching. As shown in FIG. 10, the overlapping end portions can be top stitched down to conceal much of the stitch and flatten the seam. The back side of the seam forms a ladder pattern joining the lines of stitching back and forth while the front side of the seam appears as two parallel lines with the folded layers in between the lines. In certain aspects and when joining the overlapped end portions, overlock coverstitching provides ample elasticity to enable the joined multilayered fabrics, which forms the shield. This elasticity allows the shield to move with the wearer and remain positioned correctly against the sweat glands when the shield has been fixed/attached to a tee shirt. In addition, although commonly used for sport apparel, flat-lock stitching may be disadvantageous to use to join the overlapping end portions. For example, in certain aspects, flat-lock stitching is not suitable for forming the seam (e.g., when joining (650) and (850)) because flat-lock stitching may not allow ample absorption of perspiration by the shield, and in certain aspects, flat-lock stitching can result in a shield that is not waterproof.

In certain aspects, the articles (e.g., the shields) described herein can be configured in a different manner than described above. For example, in certain aspects, the articles (e.g., the shields) described above can be configured to be included in the bust line of a woman's tee shirt and can be configured to wick away sweat from a woman's bust line. For example, the articles described herein can be placed in between a woman's breast and upper abdominal area to wick away and absorb perspiration as described above.

What is claimed is:

1. A shield adapted for permanent attachment in the armpit area of a shirt, the shield comprising a multilayered fabric wherein:

the multilayered fabric comprises a first fabric layer, a second fabric layer, and a third fabric layer;

the first fabric layer is configured to be closest to a wearer's body and is configured to wick moisture away from the wearer's body;

the second fabric layer is disposed between the first fabric layer and the third fabric layer and is configured to absorb moisture;

the third fabric layer is configured to be the outermost fabric layer relative to the wearer's body and does not absorb moisture, wherein:

the first and second surface of the first fabric layer are opposite one another and the first surface of the first fabric layer is configured to be closest to the wearer's body;

the first surface of the first fabric layer has a tighter weave relative to the second surface of the first fabric layer; and the second surface of the first fabric layer has a looser weave relative to the first surface of the first fabric layer and is directly adjacent to a portion of the second fabric layer.

2. The shield of claim 1, wherein the first layer comprises a polyester.

3. The shield of claim 2, wherein the polyester comprises polyethylene terephthalate, polybutylene terephthalate, polytrimethylene terephthalate, or any combination thereof.

4. The shield of claim 1, wherein the second fabric layer comprises a material that is more hygroscopic than the first fabric layer and the third fabric layer, wherein:

the material of the second fabric layer comprises at least 90 wt % bamboo;

the material of the second fabric layer does not include cotton; and the second fabric layer is at least 50% more hygroscopic than cotton.

5. The shield of claim 4, wherein the second fabric layer further comprises an antimicrobial agent, wherein:

the antimicrobial agent comprises copper, copper salts, silver, silver salts, nickel, nickel salts, or any combination thereof.

6. The shield of claim 4, wherein the third fabric layer comprises a first and second surface, wherein:

the first and second surfaces are opposite one another; and at least one of the first surface of the third fabric layer or the second surface of the third fabric layer is waterproof.

7. The shield of claim 6, wherein the at least one of the first surface of the third fabric layer or the second surface of the third fabric layer comprises a waterproof polyurethane coating.

8. The shield of claim 7, wherein the waterproof polyurethane coating comprises a polyurethane laminate film.

9. The shield of claim 6, wherein the third fabric layer comprises 30 to 80 wt % polyurethane and 35 to 60 wt % polyester.

10. The shield of claim 9, wherein the third fabric layer further comprises at least one antimicrobial agent selected from the group consisting of copper, copper salts, silver, silver salts, nickel, nickel salts, or any combination thereof.

11. The shield of claim 6, wherein at least an end portion of the first fabric layer, at least an end portion of the second fabric layer, and at least an end portion of the third fabric layer converge, and the converged end portions are fixably attached to one another to form a seam in the shield, an outer periphery of the shield, or a combination thereof.

12. The shield of claim 6, wherein an end portion of the third fabric layer is looped around an end portion of the first fabric layer and an end portion of the second fabric layer, wherein:

the end portion of the third fabric layer is fixably attached to the end portion of the first fabric layer and the end portion of the second fabric layer to form a seam in the shield, an outer periphery of the shield, or a combination thereof.

13. A shield adapted for permanent attachment in the armpit area of a shirt, the shield comprising a multilayered fabric wherein:

the multilayered fabric comprises a first fabric layer, a second fabric layer, and a third fabric layer;

the first fabric layer is configured to be closest to a wearer's body and is configured to wick moisture away from the wearer's body;

the second fabric layer is disposed between the first fabric layer and the third fabric layer and is configured to absorb moisture;

the third fabric layer is configured to be the outermost fabric layer relative to the wearer's body and does not absorb moisture; and at least an end portion of the first fabric layer, at least an end portion of the second fabric layer, and at least an end portion of the third fabric layer converge, and the converged end portions are fixably attached to one another to form a seam in the shield, an outer periphery of the shield, or a combination thereof.

14. A shield adapted for permanent attachment in the armpit area of a shirt, the shield comprising a multilayered fabric wherein:

the multilayered fabric comprises a first fabric layer, a second fabric layer, and a third fabric layer;

the first fabric layer is configured to be closest to a wearer's body and is configured to wick moisture away from the wearer's body;

the second fabric layer is disposed between the first fabric layer and the third fabric layer and is configured to absorb moisture; and the third fabric layer is configured to be the outermost fabric layer relative to the wearer's body and does not absorb moisture;

the end portion of the third fabric layer is looped around an end portion of the first fabric layer and an end portion of the second fabric layer; and the end portion of the third fabric layer is fixably attached to the end portion of the first fabric layer and the end portion of the second fabric layer to form a seam in the shield, an outer periphery of the shield, or a combination thereof.

15. A shield adapted for removable attachment in the armpit area of a shirt, the shield comprising a multilayered fabric wherein:

the multilayered fabric comprises a first fabric layer, a second fabric layer, and a third fabric layer;

the first fabric layer is configured to be closest to a wearer's body and is configured to wick moisture away from the wearer's body;

the second fabric layer is disposed between the first fabric layer and the third fabric layer and is configured to absorb moisture; and the third fabric layer is configured to be the outermost fabric layer relative to the wearer's body and does not absorb moisture, wherein the first fabric layer comprises a woven material having a first and a second surface, wherein:

the first and second surface of the first fabric later are opposite one another and the first surface of the first fabric layer is configured to be closest to the wearer's body;

the first surface of the first fabric laver has a tighter weave relative to the second surface of the first fabric laver;

the second surface of the first fabric layer has a looser weave relative to the first surface of the first fabric layer and is directly adjacent to a portion of the second fabric laser.

16. The shield of claim 15, wherein the first fabric layer comprises a polyester.

17. The shield of claim 16, wherein the polyester is at least one selected from the group consisting of polyethylene terephthalate, polybutylene terephthalate, polytrimethylene terephthalate, and any combination thereof.

18. The shield of claim 16, wherein the second fabric layer comprises a material that is more hygroscopic than the first fabric layer and the third fabric layer, wherein:

the material of the second fabric layer comprises at least 90 wt % bamboo;

the material of the second fabric layer does not include cotton; and the second fabric layer is at least 50% more hygroscopic than cotton.

19. The shield of claim 18, wherein the second fabric layer further comprises an antimicrobial agent, wherein:

the antimicrobial agent comprises copper, copper salts, silver, silver salts, nickel, nickel salts, or any combination thereof.

20. The shield of claim 18, wherein the third fabric layer comprises a first and second surface, wherein:

the first and second surfaces are opposite one another; and at least one of the first surface of the third fabric layer or the second surface of the third fabric layer is waterproof.

21. The shield of claim 20, wherein the at least one of the first surface of the third fabric layer or the second surface of the third fabric layer comprises a waterproof polyurethane coating.

22. The shield of claim 21, wherein the waterproof polyurethane coating comprises a polyurethane laminate film.

23. The shield of claim 20, wherein the third fabric layer comprises 30 to 80 wt % polyurethane and 35 to 60 wt % polyester.

24. The shield of claim 23, wherein the third fabric layer further comprises at least one antimicrobial agent selected from the group consisting of copper, copper salts, silver, silver salts, nickel, nickel salts, or any combination thereof.

25. The shield of claim 20, wherein at least an end portion of the first fabric layer, at least an end portion of the second fabric layer, and at least an end portion of the third fabric layer converge, and the converged end portions are fixably attached to one another to form a seam in the shield, an outer periphery of the shield, or a combination thereof.

26. The shield of claim 20, wherein an end portion of the third fabric layer is looped around an end portion of the first fabric layer and an end portion of the second fabric layer, wherein:

the end portion of the third fabric layer is fixably attached to the end portion of the first fabric layer and the end portion of the second fabric layer to form a seam in the shield, an outer periphery of the shield, or a combination thereof.

27. The shield of claim 15, wherein at least an end portion of the first fabric layer, at least an end portion of the second fabric layer, and at least an end portion of the third fabric layer converge, and the converged end portions are fixably attached to one another to form a seam in the shield, an outer periphery of the shield, or a combination thereof.

28. The shield of claim 15, wherein the end portion of the third fabric layer is looped around an end portion of the first fabric layer and an end portion of the second fabric layer, wherein:

the end portion of the third fabric layer is fixably attached to the end portion of the first fabric layer and the end portion of the second fabric layer to form a seam in the shield, an outer periphery of the shield, or a combination thereof.

* * * * *